US012050041B2

(12) United States Patent
Tice et al.

(10) Patent No.: US 12,050,041 B2
(45) Date of Patent: Jul. 30, 2024

(54) ALTERNATIVE DEFROST MODE OF HVAC SYSTEM

(71) Applicant: Johnson Controls Tyco IP Holdings LLP, Milwaukee, WI (US)

(72) Inventors: Steven A. Tice, Wichita, KS (US); Shaun B. Atchison, Wichita, KS (US); Noel A. Grajeda-Trevizo, Newton, KS (US); Andrew M. Boyd, Wichita, KS (US)

(73) Assignee: TYCO FIRE & SECURITY GMBH, Schaffhausen (CH)

( * ) Notice: Subject to any disclaimer, the term of this patent is extended or adjusted under 35 U.S.C. 154(b) by 0 days.

(21) Appl. No.: 18/053,263

(22) Filed: Nov. 7, 2022

(65) Prior Publication Data

US 2024/0151446 A1 May 9, 2024

Related U.S. Application Data

(63) Continuation of application No. 16/684,200, filed on Nov. 14, 2019, now Pat. No. 11,493,221.

(60) Provisional application No. 62/874,398, filed on Jul. 15, 2019.

(51) Int. Cl.

| | |
|---|---|
| ***F24F 11/38*** | (2018.01) |
| ***F24F 11/42*** | (2018.01) |
| ***F25B 47/02*** | (2006.01) |

(52) U.S. Cl.

CPC ..... *F25B 47/025* (2013.01); *F24F 11/38* (2018.01); *F24F 11/42* (2018.01); *F25B 2347/02* (2013.01); *F25B 2600/01* (2013.01); *F25B 2700/11* (2013.01); *F25B 2700/2103* (2013.01); *F25B 2700/2106* (2013.01)

(58) Field of Classification Search

CPC ..... F24F 11/38; F24F 11/42; F25B 47/025; F25B 2347/02; F25B 2600/01; F25B 2700/11; F25B 2700/2103; F25B 2700/2106

See application file for complete search history.

(56) References Cited

U.S. PATENT DOCUMENTS

| | | | |
|---|---|---|---|
| 4,660,386 | A | 4/1987 | Hansen et al. |
| 4,850,204 | A | 7/1989 | Bos et al. |
| 4,884,414 | A | 12/1989 | Bos |
| 4,977,751 | A | 12/1990 | Hanson |

(Continued)

FOREIGN PATENT DOCUMENTS

| | | | |
|---|---|---|---|
| CN | 106979597 | A | 7/2017 |

OTHER PUBLICATIONS

"Split System Heat Pump, A4HP4023A1000A," May 6, 2019, 16 pages, Ingersoll Rand.

*Primary Examiner* — Jonathan Bradford
(74) *Attorney, Agent, or Firm* — Fletcher Yoder, PC

(57) ABSTRACT

Embodiments of the present disclosure are directed to a controller for a heating, ventilation, and/or air conditioning (HVAC) system. The controller is configured to operate in a first defrost mode or a second defrost mode, determine that feedback from a first sensor of the HVAC system is unavailable, receive feedback from a second sensor of the HVAC system, and operate the HVAC system in the second defrost mode instead of the first defrost mode in response to unavailability of the feedback from the first sensor and based on the feedback from the second sensor.

20 Claims, 15 Drawing Sheets

(56) References Cited

U.S. PATENT DOCUMENTS

| | | | | |
|---|---|---|---|---|
| 5,201,185 | A | 4/1993 | Hanson et al. | |
| 5,237,830 | A | 8/1993 | Grant | |
| 5,440,893 | A | 8/1995 | Davis et al. | |
| 5,507,154 | A | 4/1996 | Grant | |
| 5,630,325 | A | 5/1997 | Bahel et al. | |
| 5,765,382 | A | 6/1998 | Manning et al. | |
| 5,801,940 | A | 9/1998 | Russ et al. | |
| 7,047,753 | B2 | 5/2006 | Street et al. | |
| 8,869,545 | B2 | 10/2014 | Chen et al. | |
| 10,274,382 | B1 * | 4/2019 | Trundle | G01K 13/00 |
| 2005/0159846 | A1 | 7/2005 | Van Ostrand et al. | |
| 2007/0209380 | A1 | 9/2007 | Mueller et al. | |
| 2009/0183519 | A1 | 7/2009 | Nishikawa et al. | |
| 2009/0266092 | A1 | 10/2009 | Harrod et al. | |
| 2012/0291984 | A1 | 11/2012 | Li et al. | |
| 2014/0026601 | A1 | 1/2014 | Chen et al. | |
| 2014/0196484 | A9 | 7/2014 | Chen et al. | |
| 2014/0208785 | A1 | 7/2014 | Wallace et al. | |
| 2014/0321839 | A1 * | 10/2014 | Armstrong | F24H 15/254<br>392/498 |
| 2015/0211779 | A1 | 7/2015 | Brandt et al. | |
| 2015/0285539 | A1 | 10/2015 | Kopko | |
| 2015/0321298 | A1 | 11/2015 | Chen et al. | |
| 2018/0172370 | A1 | 6/2018 | Aeberhard et al. | |
| 2018/0284745 | A1 | 10/2018 | Cella et al. | |
| 2018/0320946 | A1 | 11/2018 | Goel et al. | |
| 2019/0353370 | A1 | 11/2019 | Hern et al. | |
| 2022/0011031 | A1 | 1/2022 | Brasuell et al. | |

* cited by examiner

ALTERNATIVE DEFROST MODE OF HVAC SYSTEM

CROSS REFERENCE TO RELATED APPLICATIONS

This application is a continuation of U.S. patent application Ser. No. 16/684,200, entitled "ALTERNATIVE DEFROST MODE OF HVAC SYSTEM," filed Nov. 14, 2019, which claims priority from and the benefit of U.S. Provisional Application No. 62/874,398, entitled "ALTERNATIVE DEFROST MODE OF HVAC SYSTEM," filed Jul. 15, 2019, each of which is hereby incorporated by reference.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of an air flow delivered to the environment. For example, the HVAC system may place the air flow in a heat exchange relationship with a refrigerant to condition the air flow. The HVAC system may operate based on certain operating parameters determined by various sensors of the HVAC system. In some circumstances, feedback from one of the sensors may be unavailable. As a result, the HVAC system may not properly operate based on the determined operating parameters to condition the air flow, and a performance of the HVAC system may be affected.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a controller for a heating, ventilation, and/or air conditioning (HVAC) system is configured to operate in a first defrost mode or a second defrost mode, determine that feedback from a first sensor of the HVAC system is unavailable, receive feedback from a second sensor of the HVAC system, and operate the HVAC system in the second defrost mode instead of the first defrost mode in response to unavailability of the feedback from the first sensor and based on the feedback from the second sensor.

In another embodiment, a controller for a heat pump, in which the controller includes a tangible, non-transitory, computer-readable medium with computer-executable instructions that, when executed, are configured to cause a processor to determine that a temperature measurement from a sensor of the heat pump is unavailable, receive an alternative temperature measurement from a component of the heat pump, and operate the heat pump in an alternative defrost mode instead of a primary defrost mode in response to unavailability of the temperature measurement from the sensor and based on the alternative temperature measurement.

In another embodiment, a heating, ventilation, and air conditioning (HVAC) system includes a sensor configured to transmit feedback indicative of a temperature, and a controller communicatively coupled to the sensor. The controller is configured to determine if the feedback indicative of the temperature is available, operate the HVAC system in a first defrost mode based on the feedback in response to determining the feedback is available, and operate the HVAC system in a second defrost mode in response to determining the feedback from the sensor is unavailable.

DRAWINGS

Various aspects of this disclosure may be better understood upon reading the following detailed description and upon reference to the drawings in which.

DETAILED DESCRIPTION

Figure 1:
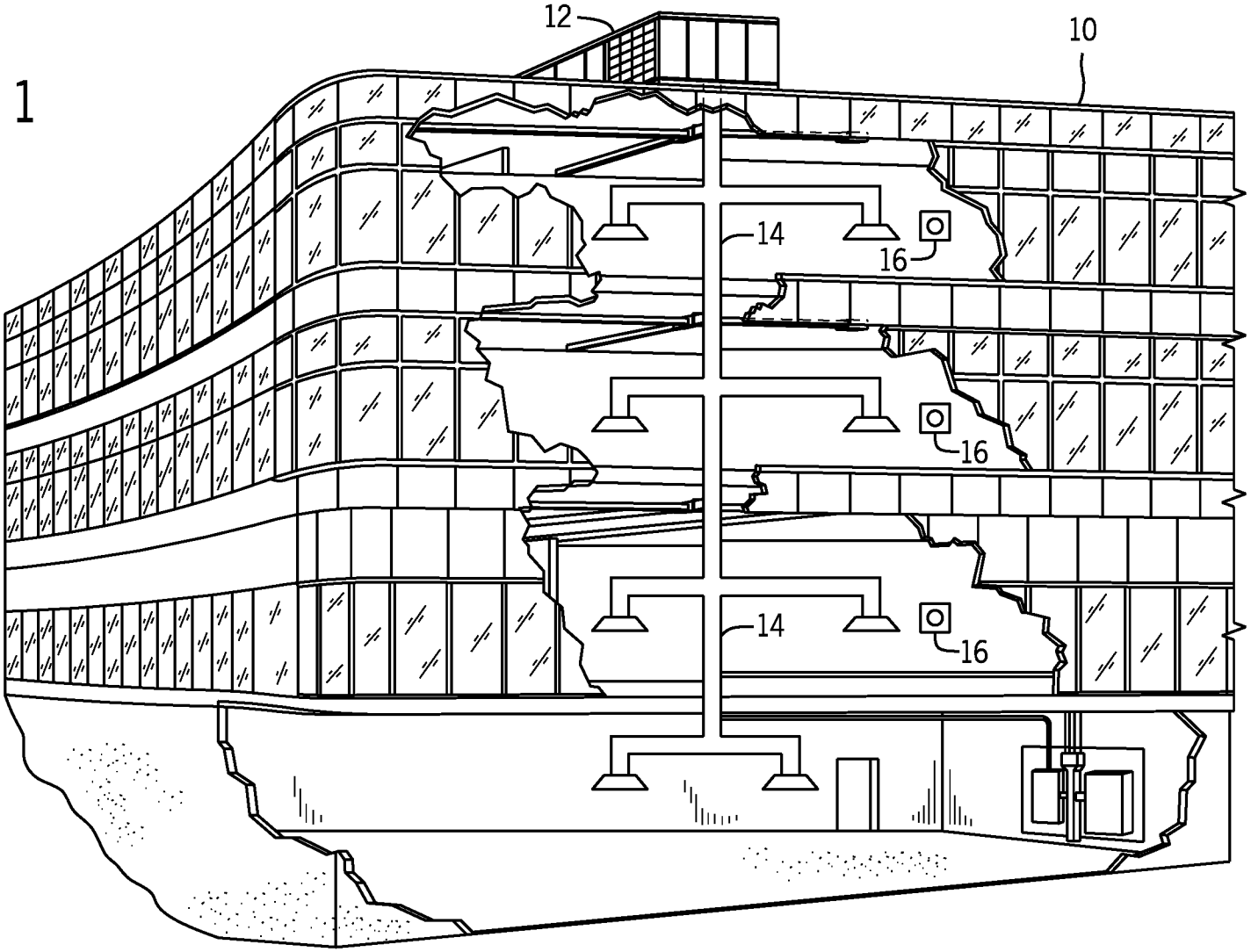
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system configured to condition an air flow based on various operating parameters determined by sensors of the HVAC system. For example, operation of components of the HVAC system, such as a compressor, an expansion valve, a fan, and so forth, may be based on detections made by the sensors, such as operating parameter measurements. Such detections may enable the HVAC system to condition the air flow as desired, such as by reducing a temperature of the air flow to a desirable or comfortable level to be provided to a space serviced by the HVAC system. In some embodiments, the HVAC system is a heat pump that may operate in a primary or normal defrost mode to heat a heat exchanger coil when feedback from certain sensors of the HVAC system is available. In additional or alternative embodiments, the HVAC system may operate in a primary or normal conditioning mode to condition the air flow when feedback from certain sensors of the HVAC system is available.

However, in some circumstances, the feedback from one of the sensors may be faulty, missing, or otherwise unavailable. As an example, a particular refrigerant sensor may not properly provide feedback indicative of a particular operating parameter. In such circumstances, the HVAC system may not be able to operate effectively or efficiently to condition the air flow based on the particular operating parameter. For instance, the HVAC system may not be able to operate effectively to reduce a temperature of the air flow to a desirable temperature, or the operation of the HVAC system may be disabled or suspended.

Thus, it is now recognized that operation of the HVAC system to condition the air flow effectively is desirable when feedback from a sensor of the HVAC system is unavailable so as to maintain the performance of the HVAC system and/or to avoid suspension of the HVAC system operation. Accordingly, embodiments of the present disclosure are directed to systems and methods for utilizing alternative types of feedback when feedback that is traditionally utilized is not available. For example, an HVAC system of the present disclosure is configured to continue operating when first sensor feedback is unavailable. When the first sensor feedback is unavailable, the HVAC system may utilize second sensor feedback instead. For example, the HVAC system may operate in an alternative defrost mode instead of a normal defrost mode when certain sensor feedback is unavailable by using different, available sensor feedback instead. Additionally or alternatively, the HVAC system may operate in an alternative conditioning mode instead of a normal conditioning mode when a certain sensor feedback is unavailable by using different, available sensor feedback instead. As such, HVAC system may continue to operate effectively even when feedback from particular sensors is unavailable.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
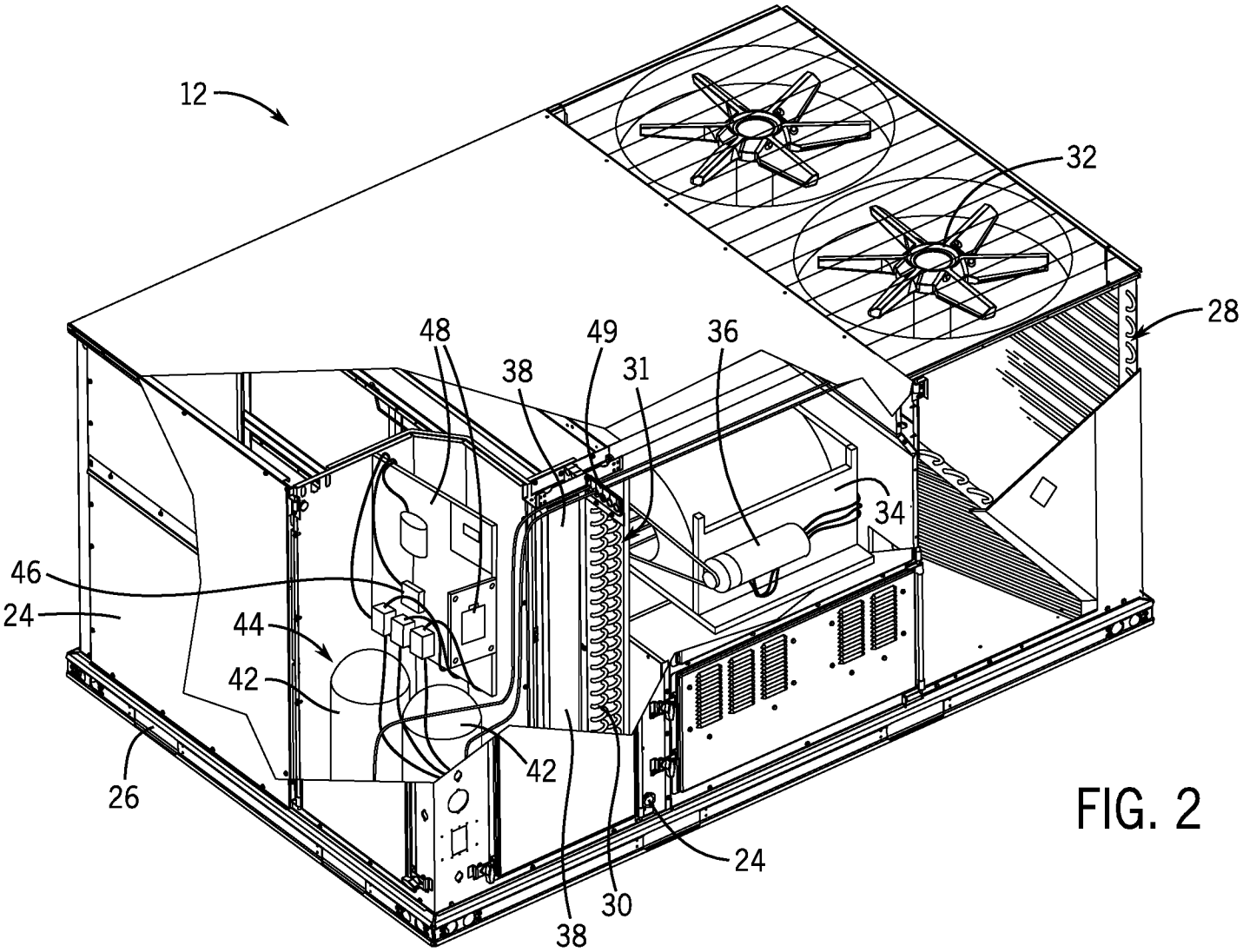
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
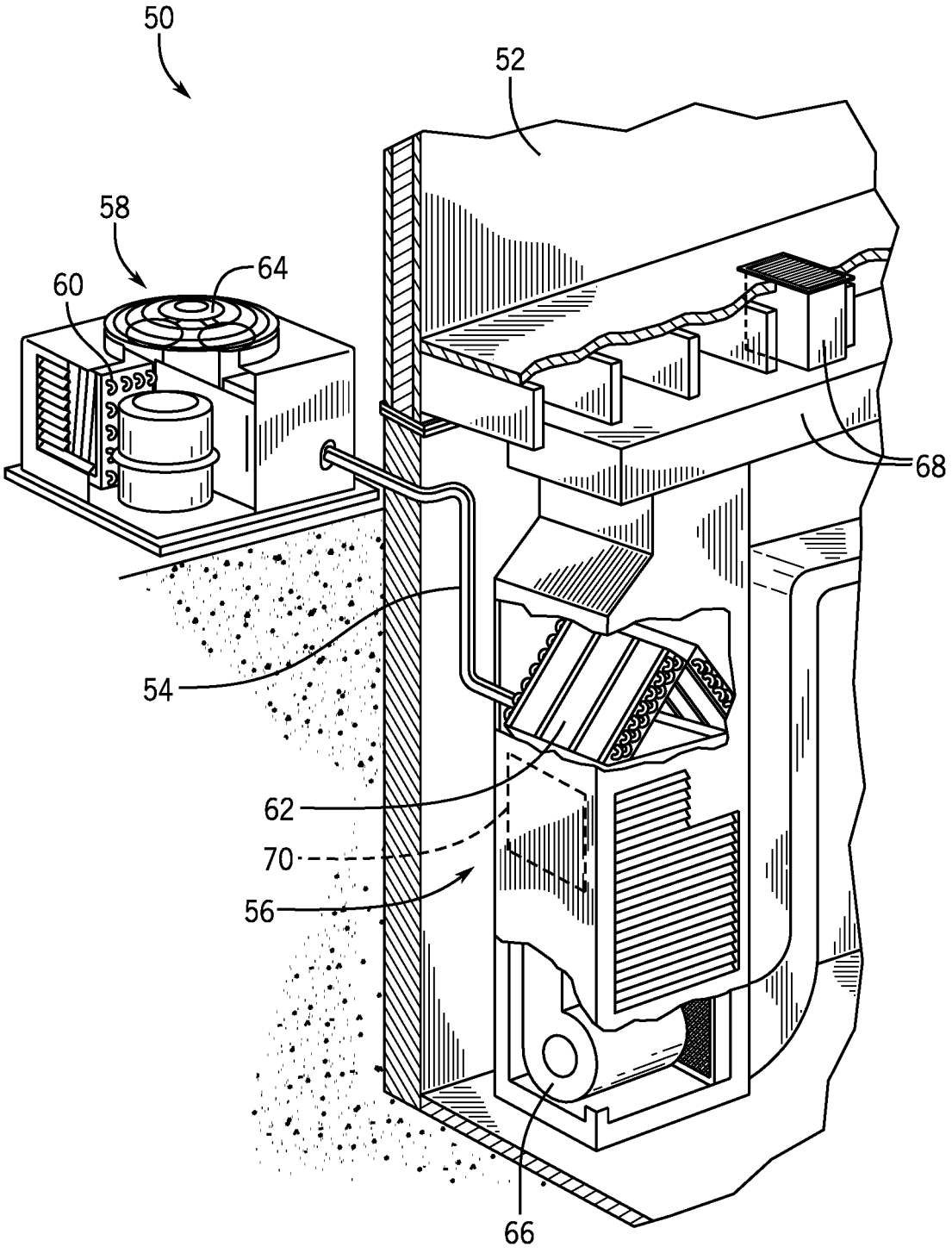
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
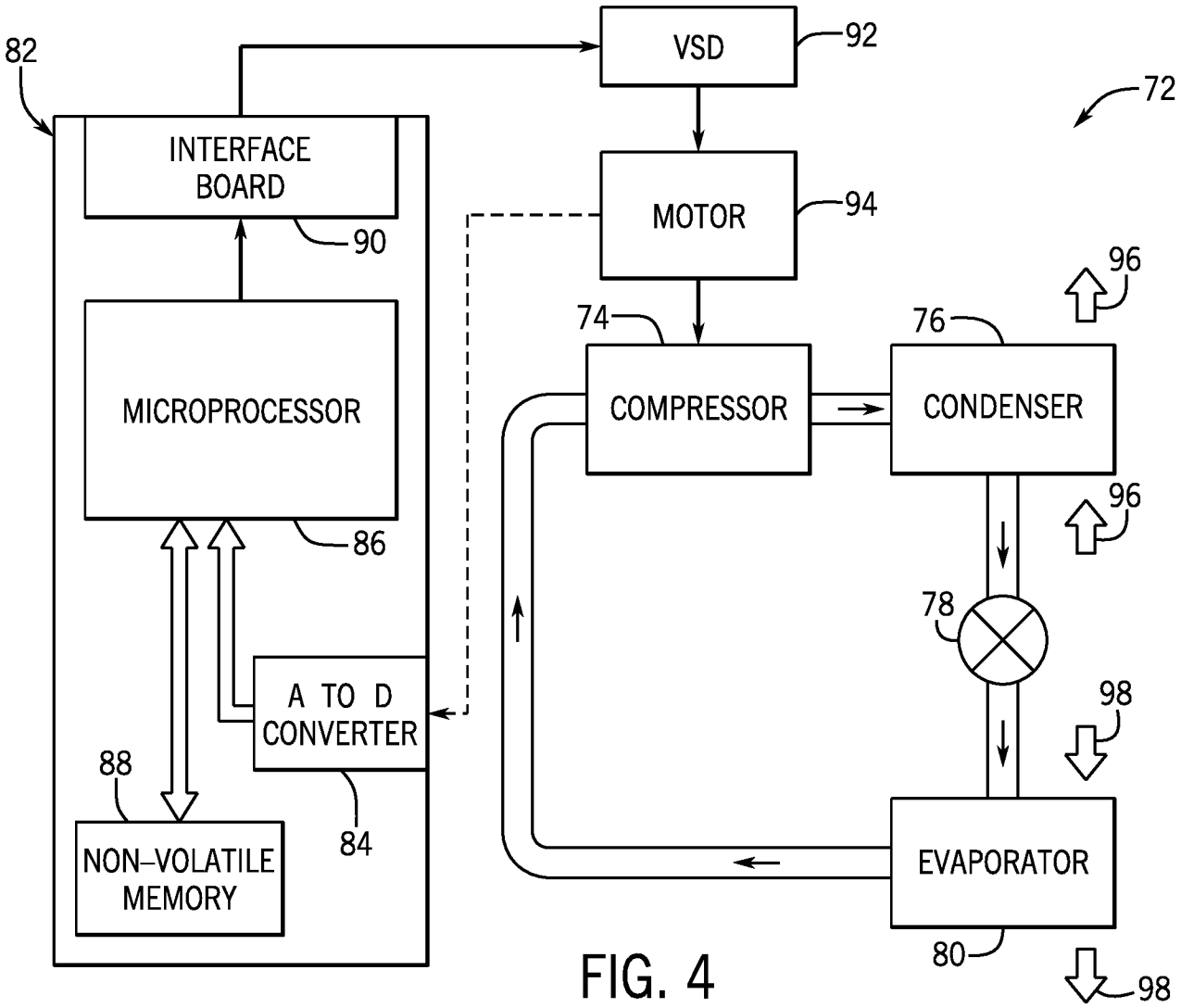
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be noted that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The present disclosure is directed to a heating, ventilation, and/or air conditioning (HVAC) system configured to operate based on feedback from sensors of the HVAC system. The feedback may include detections of various operating parameters that may be used to enable the HVAC system to condition an air flow, such as to reduce a temperature of the air flow more accurately. If feedback from a particular sensor is unavailable, and therefore the operating parameter determined by the particular sensor is unavailable, the HVAC system may receive feedback from a different sensor instead. Such alternative feedback may be indicative of a different operating parameter. The HVAC system may then operate by using the different operating parameter instead of the operating parameter that is unavailable. In this manner, embodiments of the HVAC system disclosed herein are configured to continue operation to condition the air flow even if feedback from certain sensors is unavailable.

In some embodiments, the HVAC system may be a heat pump configured to operate in a defrost mode to heat an outdoor coil of the HVAC system. The defrost mode may maintain the temperature of the outdoor coil to be above a threshold temperature to maintain a desired performance of the HVAC system. For instance, during operation of the HVAC system to condition an air flow, a temperature of an ambient environment and/or a temperature of a flow of refrigerant through the HVAC system may cause a reduction in the temperature of the outdoor coil. These operating parameters are typically detected by an outdoor ambient sensor, such as an ambient temperature sensor, of the HVAC system and by an outdoor coil sensor, such as an outdoor coil temperature sensor, of the HVAC system. The reduction in temperature of the outdoor coil may cause frost to form on the outdoor coil and may cause the HVAC system to operate inefficiently.

Based on feedback from the outdoor ambient sensor and the outdoor coil sensor, the HVAC system may operate in a primary defrost mode to raise the temperature of the outdoor coil. As used herein, a "primary defrost mode" includes running a defrost cycle or a series of defrost cycles during normal operation of the HVAC system, such as when feedback from the outdoor ambient sensor, or an ambient temperature measurement, and feedback from the outdoor coil sensor, or an outdoor coil temperature measurement, is available for use by the HVAC system. Each defrost cycle may generally include operating the HVAC system to direct heated refrigerant through the outdoor coil. Certain parameters of each defrost cycle, including an operation time of a compressor, a temperature of the refrigerant, an operational time limit, and so forth, may be based on certain conditions of the HVAC system to defrost the outdoor coil effectively and maintain the outdoor coil in a defrosted state for an adequate period of time. Each defrost cycle in the primary defrost mode may operate until a threshold temperature of the outdoor coil is achieved and/or after the expiration of a designated time limit of operation, such as a time between 10 minutes and 20 minutes. Additionally, subsequent defrost cycles may be executed based on a previously-executed defrost cycle, such as based on an outdoor coil temperature attained as a result of the previously-executed defrost cycle. Thus, the parameters of each defrost cycle may be dynamically adjusted to defrost the outdoor coil efficiently.

The HVAC system of the present disclosure is configured to raise the temperature of the outdoor coil even when feedback from the outdoor ambient sensor and/or the outdoor coil sensor is unavailable in order to maintain the desired performance of the HVAC system and/or to avoid suspension of HVAC system operation. By way of example, the HVAC system may operate in an alternative defrost mode instead of the primary defrost mode when it is determined that the outdoor ambient sensor temperature measurement and/or the outdoor coil temperature sensor measurement is unavailable. As used herein, an "alternative defrost mode" includes operation of the HVAC system to maintain the temperature of the outdoor coil above the threshold temperature when feedback from the outdoor ambient sensor and/or the outdoor coil sensor is unavailable. In the alternative defrost mode, the HVAC system may direct heated refrigerant to the outdoor coil based on an alternative temperature measurement, such that the HVAC system may continue to maintain the temperature of the outdoor coil above the threshold temperature. In some embodiments, the HVAC system may operate in one of several alternative defrost modes based on available alternative temperature measurements. As such, the desired performance of the HVAC system to defrost the outdoor coil and to condition the air flow may be maintained even when feedback from the outdoor ambient sensor and/or the outdoor coil sensor is unavailable. Thus, the disclosed alternative defrost modes enable a desired performance of the HVAC system to be maintained. Although this disclosure primarily discusses operating in various defrost modes to raise a temperature of the outdoor coil, in additional or alternative embodiments, the HVAC system may operate in various defrost modes to raise a temperature of another component of the HVAC system, such as an indoor coil, a compressor, a section of tubing or conduit, and the like.

Figure 5:
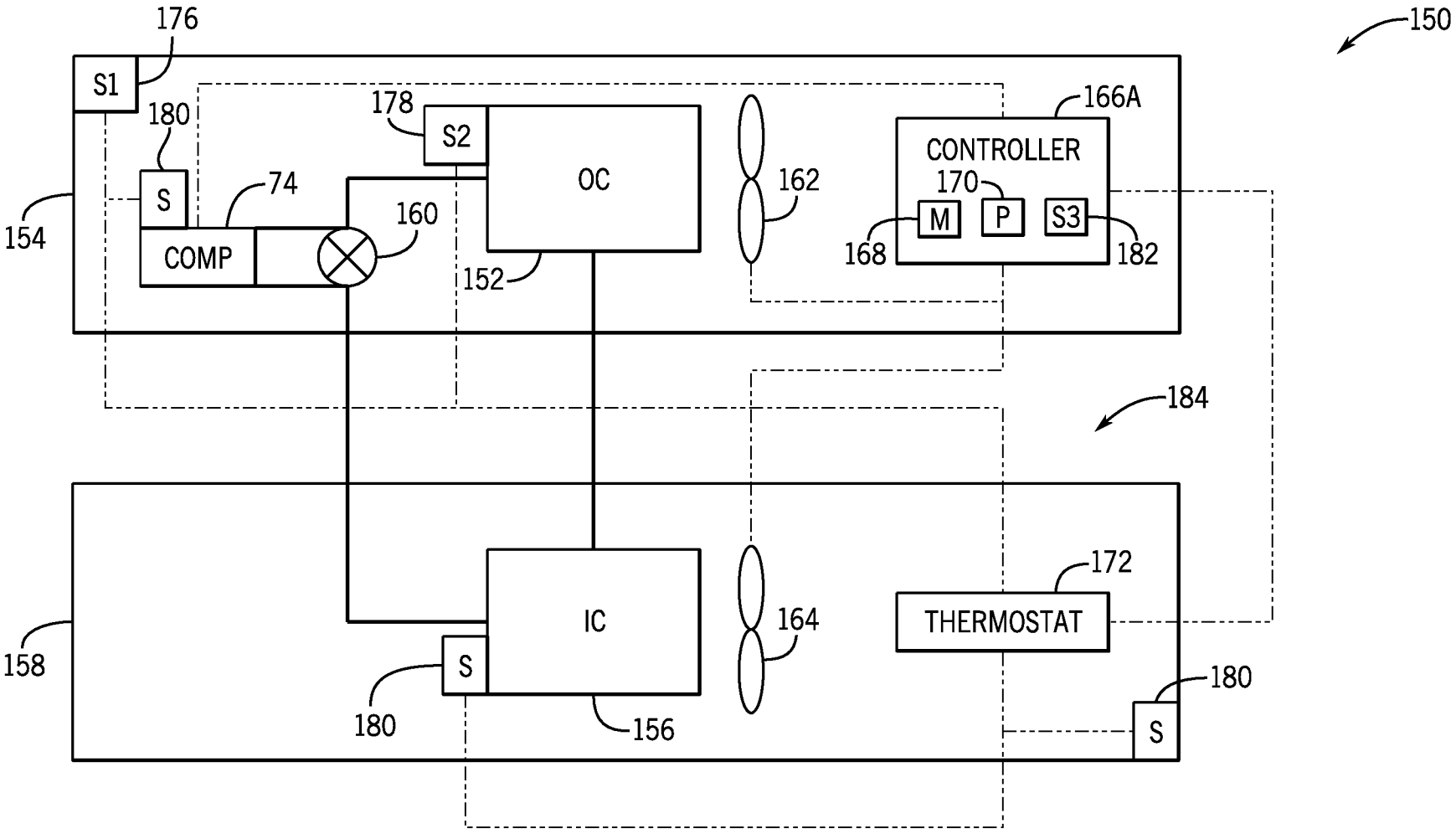
FIG. 5 is a schematic of an embodiment of a heat pump system having a simplified control configuration configured to operate the heat pump system, in accordance with an aspect of the present disclosure.

FIG. 5 is a schematic of an embodiment of a heat pump system 150 configured to operate in a heating mode and in a cooling mode. The heat pump system 150 may include components similarly as those described with reference to the HVAC unit 12 and/or the residential heating and cooling system 50. For example, the heat pump system 150 may have a refrigerant circuit that is similar to the vapor compression system described above and is used to condition an air flow via heat exchange with a refrigerant flowing through the refrigerant circuit. The heat pump system 150 may then deliver the conditioned air flow to a structure, such as the building 10 or the residence 52, to condition the structure.

The heat pump system 150 may have an outdoor coil 152, which may be located along the refrigerant circuit of the heat pump system 150 in an ambient environment 154, and an indoor coil 156, which may be located along the refrigerant circuit of the heat pump system 150 within a structure 158, such as a building. The heat pump system 150 may further include the compressor 74 configured to pressurize refrigerant flowing through the refrigerant circuit of the heat pump system 150 and a reversing valve 160 configured to adjust a flow direction of the refrigerant through the heat pump system 150.

In the cooling mode, the heat pump system 150 may deliver cooled air to the structure 158. For instance, the reversing valve 160 may be in a first position that enables refrigerant to flow from the indoor coil 156 to the compressor 74 and from the compressor 74 to the outdoor coil 152. That is, the compressor 74 receives the refrigerant from the indoor coil 156 and then pressurizes the refrigerant to heat the refrigerant. The compressor 74 then directs the heated refrigerant to the outdoor coil 152, where the heated refrigerant may be cooled via an air flow force across the outdoor coil 152 with an outdoor fan 162. The resulting cooled refrigerant may then be directed to the indoor coil 156, and an indoor fan 164 may draw or force a supply air flow across the indoor coil 156 to enable the supply air flow to exchange heat with the cooled refrigerant, thereby cooling the supply air flow and heating the refrigerant. The cooled supply air flow may then be directed to a conditioned space of the structure 158 to cool the conditioned space, and the refrigerant is directed from the indoor coil 156 back to the compressor 74.

In the heating mode, the heat pump system 150 may deliver heated air to the conditioned space within the structure 158. For instance, the reversing valve 160 may adjust to be in a second position that enables refrigerant to flow from the outdoor coil 152 to the compressor 74 and from the compressor 74 to the indoor coil 156. Thus, the compressor 74 receives the refrigerant from the outdoor coil 152 and then pressurizes the refrigerant to heat the refrigerant. The compressor 74 then directs the heated refrigerant to the indoor coil 156, where the indoor fan 164 may draw or force the supply air flow across the indoor coil 156 to enable the supply air flow to exchange heat with the heated refrigerant, thereby heating the supply air flow and cooling the refrigerant. The heated supply air flow may be directed to the conditioned space within the structure 158 to heat the conditioned space. The cooled refrigerant may then be directed from the indoor coil 156 to the outdoor coil 152, where the cooled refrigerant may exchange heat with the ambient air to heat the refrigerant, such as via an air flow forced across the outdoor coil 152 with the outdoor fan 162. The refrigerant is then directed from the outdoor coil 152 to the compressor 74.

In certain implementations, the outdoor fan 162 and/or the indoor fan 164 may be a variable speed fan. That is, an operational speed of the outdoor fan 162 and/or the indoor fan 164 may be adjustable to various operational speeds, such as to a low operational speed, a high operational speed, and/or an intermediate operational speed between the low operational speed and the high operational speed. Adjusting the operational speed of the outdoor fan 162 and/or the indoor fan 164 may enable various amounts of heat to transfer between the respective air flows forced across the outdoor coil 152 and the indoor coil 156, respectively. In alternative embodiments, the outdoor fan 162 and/or the indoor fan 164 may be a single speed fan and may be switched on or off but may not be operated at various operating speeds.

The heat pump system 150 may include a controller 166 configured to selectively operate the heat pump system 150 in the cooling mode and in the heating mode. The controller 166 may include a memory 168 and a processor 170. The memory 168 may include volatile memory, such as random access memory (RAM), and/or non-volatile memory, such as read-only memory (ROM), optical drives, hard disc drives, solid-state drives, or any other non-transitory computer-readable medium that includes instructions to operate the heat pump system 150. The processor 170 may be configured to execute such instructions. For example, the processor 170 may include one or more application specific integrated circuits (ASICs), one or more field programmable gate arrays (FPGAs), one or more general purpose processors, or any combination thereof.

In some embodiments, the controller 166 may be communicatively coupled to a thermostat 172, which may be used to designate a target or desired temperature of the conditioned space within the structure 158. The target temperature may be set manually via a user input of the thermostat 172 and/or automatically via a programmed setting. Based on the target temperature, the controller 166 may operate the heat pump system 150 in the cooling mode or in the heating mode, such as by adjusting the position of the reversing valve 160. For example, if the target temperature is above a current temperature of the conditioned space by a temperature threshold, the controller 166 may operate the heat pump system 150 in the cooling mode to lower the current temperature of the conditioned space within the structure 158. If the target temperature is below the current temperature of the conditioned space by another temperature threshold, the controller 166 may operate the heat pump system 150 in the heating mode to raise the current temperature of the conditioned space within the structure 158.

In additional or alternative embodiments, the heat pump system 150 may include various sensors, such as an outdoor ambient sensor 176 configured to determine a temperature of the ambient environment 154 and/or an outdoor coil sensor 178 configured to determine a temperature of the outdoor coil 152. The heat pump system 150 may further include other sensors 180 configured to determine various other parameters, such as a temperature of the conditioned space within the structure 158, a temperature of the indoor coil 156, a temperature of the refrigerant entering or exiting the compressor 74, a pressure of the refrigerant entering or exiting the compressor 74, another suitable parameter, or any combination thereof. The controller 166 may operate the heat pump system 150 in the cooling mode or the heating mode based on the parameters determined by the sensors 176, 178, 180. In further embodiments, the controller 166 may include an onboard ambient temperature sensor 182 configured to determine a surrounding temperature adjacent to the controller 166. For example, the controller 166 may be a control board disposed in an enclosure or a box in the ambient environment 154, and the onboard ambient temperature sensor 182, which may be an onboard ambient temperature sensing circuit of a control board of the controller 166, may determine a surrounding temperature within the enclosure. The surrounding temperature may be approximately equal to the temperature of the ambient environment 154, and the controller 166 may use the surrounding temperature detected by the onboard ambient temperature sensor 182 to operate the heat pump system 150 in the cooling mode or in the heating mode.

In some implementations, the controller 166 may also operate the heat pump system 150 in a defrost mode to heat the outdoor coil 152. As mentioned above, operation of the heat pump system 150 in a primary defrost mode may be based on the ambient temperature determined by the outdoor ambient temperature sensor 176 and/or the outdoor coil temperature determined by the outdoor coil sensor 178. However, the temperature reading or feedback of the outdoor ambient temperature sensor 176 and/or of the outdoor coil sensor 178 may be unavailable at certain times. As such, in accordance with techniques described herein, the heat pump system 150 may operate in an alternative defrost mode to heat the outdoor coil 152. As described herein, the operation in the alternative defrost mode may vary based on the type of the controller 166 utilized with the heat pump system 150. For instance, different types of controllers 166, which may have different configurations and/or which may operate the heat pump system 150 in different manners to condition the air flow, may have correspondingly different alternative defrost modes. Additionally or alternatively, the operation in a particular alternative defrost mode may be based on a particular available temperature measurement that may substitute for a particular unavailable temperature measurement. By way of example, if a first alternative temperature measurement is available, the controller 166 may operate in a first alternative defrost mode that is based on the first alternative temperature measurement. However, if the first alternative temperature measurement is not available, but a second alternative temperature measurement is available, the controller 166 may operate in a second alternative defrost mode that is based on the second alternative temperature measurement.

In the illustrated embodiment, the controller 166 may be a simplified or a conventional controller 166A having a simplified control configuration. That is, the illustrated controller 166A is coupled to other components of the heat pump system 150 via a simplified or conventional equipment control connection system 184. The simplified controller 166A may primarily operate the heat pump system 150 in the cooling mode or in the heating mode based on feedback transmitted by the thermostat 172. For example, the thermostat 172 may be communicatively coupled to the sensors 176, 178, 180 via the simplified equipment control connection system 184, which may be configured to transmit a voltage signal to the simplified controller 166A based on the parameter readings of the sensors 176, 178, 180. Based on the received voltage signal, which may, for example, indicate that the temperature difference between a target temperature of conditioned space within the structure 158 and a current temperature of the conditioned space within the structure 158 is large, the controller 166A may operate the heat pump system 150 in the cooling mode or in the heating mode to condition the air flow appropriately. In some embodiments, the simplified controller 166A may be utilized in an embodiment of the heat pump system 150 in which the compressor 74 is a single stage compressor. In alternative embodiments, the simplified controller 166A may be utilized in an embedment of the heat pump system 150 in which the compressor 74 is a two-stage compressor configured to operate at a high capacity and a low capacity based on a demanded operation of the compressor 74. For example, the thermostat 172 may transmit a signal to operate the compressor 74 at the high capacity when greater conditioning of the air flow is desired so as to increase the temperature of the conditioned space within the structure 158 by a greater amount. The thermostat 172 may transmit another signal to operate the compressor 74 at the low capacity when lesser conditioning of the air flow is desired so as to increase the temperature of the conditioned space within the structure 158 by a smaller amount. In this manner, the thermostat 172 may be considered a sensor configured to transmit a signal indicative of various parameters to the controller 166A to operate the controller 166A in a certain operating mode.

Figure 6:
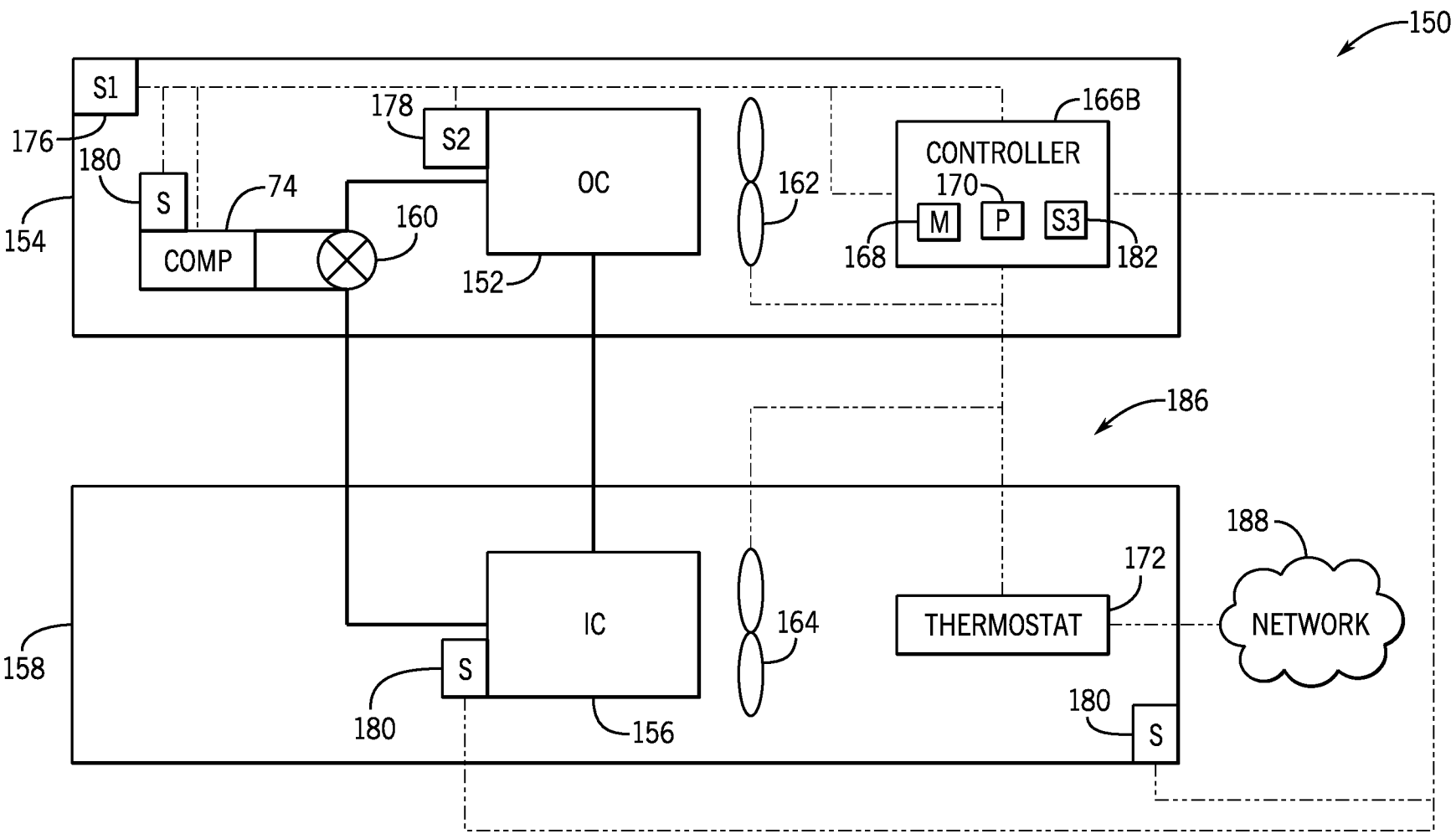
FIG. 6 is a schematic of an embodiment of a heat pump system having a two-stage compressor and a complex control configuration configured to operate the heat pump system, in accordance with an aspect of the present disclosure.

FIG. 6 is a schematic of another embodiment of the heat pump system 150 configured to operate in a heating mode and in a cooling mode. The illustrated embodiment of the heat pump system 150 includes similar elements and features as the heat pump system 150 of FIG. 5. However, the controller 166 of the heat pump system 150 of FIG. 6 is a complex controller 166B having a complex configuration. Additionally, the compressor 74 of the illustrated embodiment of FIG. 6 is a two-stage compressor configured to selectively operate at a high capacity and at a low capacity. The complex controller 166B may be communicatively coupled to the other components of the heat pump system 150 via a complex equipment control connection system 186, which may enable the complex controller 166B to receive more complex data and/or control signals than the simplistic controller 166A of FIG. 5. For instance, the complex equipment control connection system 186 may communicatively couple the complex controller 166B to the sensors 176, 178, 180 directly. Thus, the complex controller 166B may directly receive feedback from the sensors 176, 178, 180 and/or from other components of the heat pump system 150, and the complex controller 166B may operate the heat pump system 150 based on the various feedback. Indeed, the complex equipment control connection system 186 may enable two way communication between the various components of the heat pump system 150. In this manner, the complex controller 166B may coordinate with other components of heat pump system 150 to condition the air flow accordingly.

In certain implementations, the complex controller 166B may receive complex data from the thermostat 172. In other words, the communication between the complex controller 166B and the thermostat 172 may include more than mere voltage or electrical signals. For example, the complex controller 166B and the thermostat 172 may be communicatively coupled via an RS-485 connection or other data connection of the complex equipment control connection system 186. By way of example, the thermostat 172 may be communicatively coupled to a network 188, which may transmit certain information to the thermostat 172, such as various parameters that may include a current or predicted temperature of the geographical area of the heat pump system 150. The information may be transmitted by the thermostat 172 to the complex controller 166B to operate the heat pump system 150 accordingly to condition the air flow. The thermostat 172 may also transmit other information, such as database tables, algorithms, or any other suitable information that enables the complex controller 166B to operate the heat pump system 150.

Figure 7:
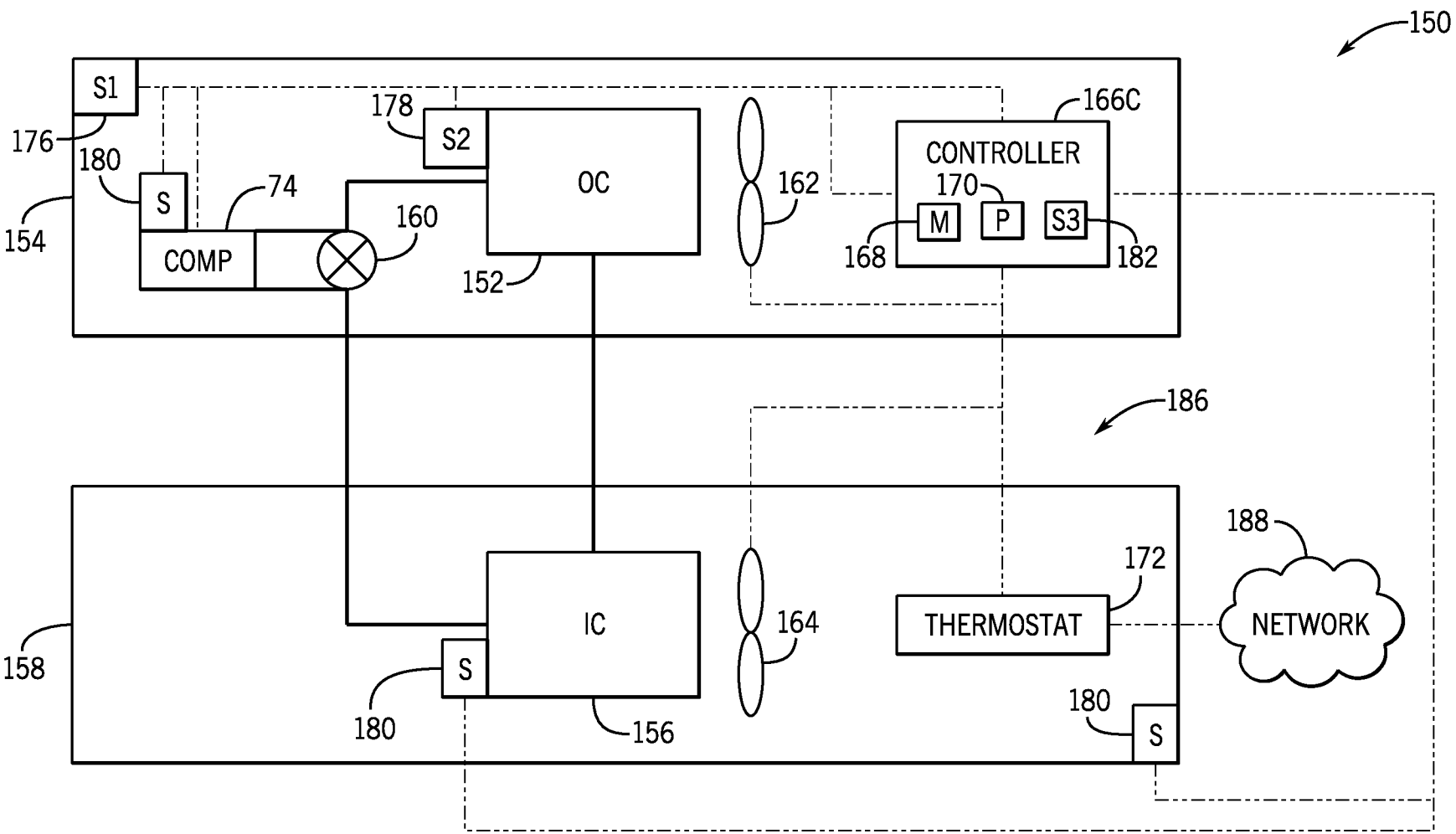
FIG. 7 is a schematic of an embodiment of a heat pump system having a variable capacity compressor and a complex control configuration configured to operate the heat pump system, in accordance with an aspect of the present disclosure.

FIG. 7 is a schematic of a further embodiment of the heat pump system 150 configured to operate in a heating mode and in a cooling mode. The illustrated embodiment of the heat pump system 150 includes similar elements and features as the heat pump system 150 of FIGS. 5 and 6. However, the controller 166 of the heat pump system 150 of FIG. 7 is a complex controller 166C, and the compressor 74 is a variable capacity compressor. As similarly described above, the complex controller 166C may also be communicatively coupled to other components of the heat pump system 150 via the complex equipment control connection system 186, and may operate the compressor 74 based on various feedback, including feedback transmitted by the thermostat 172, such as information received via the network 188. Furthermore, the complex controller 166C may operate the variable capacity compressor 74 in more than two different stages based on the received feedback, such as at one or more intermediate capacities between the high capacity and the low capacity. It should be noted that the complex controller 166C may operate the heat pump system 150 based on feedback indicative or representative of an ambient temperature that is not detected by the outdoor ambient temperature sensor 176, but the complex controller 166C may not operate the heat pump system 150 when feedback indicative of the ambient temperature is unavailable.

Each of FIGS. 8-11 illustrates a method or process for operating one or more embodiments of the heat pump system 150 in one of a variety of alternative defrost modes, where the particular alternative defrost mode is based on the particular feedback that is unavailable and/or based on a particular configuration of the heat pump system 150. For example, the methods depicted in FIGS. 8-10 may be implemented in certain embodiments of the heat pump system 150 when feedback from the outdoor ambient sensor 176 is unavailable. The method shown in FIG. 11 may be implemented in certain embodiments of the heat pump system 150 when feedback from the outdoor coil sensor 178 is unavailable. Each respective method depicted in FIGS. 8-11 may be performed by a controller of the heat pump system 150, such as the controller 166. Based on the type of controller 166, the type of compressor 74, and/or the type of equipment control connection system implemented with the heat pump system 150, the heat pump system 150 may operate according to some or all of the methods of FIGS. 8-11. In other words, based on whether the heat pump system 150 includes the simplified controller 166A, one of the complex controllers 166B, 166C, a single stage compressor, a two-stage compressor, a variable capacity compressor, the simplified equipment control connection system 184, and/or the complex equipment control connection system 186, the heat pump system 150 may be operated according to certain of the depicted methods, but, in some embodiments, may not be operated according to another of the depicted methods. It should also be noted that the respective methods may be performed or executed differently than as depicted in FIGS. 8-11, such as for different configurations of the heat pump system 150. For example, additional steps may be performed relative to the steps performed in FIGS. 8-11, and/or certain steps depicted in FIGS. 8-11 may be modified, removed, performed in a different order, and/or performed concurrently with one another.

Figure 8:
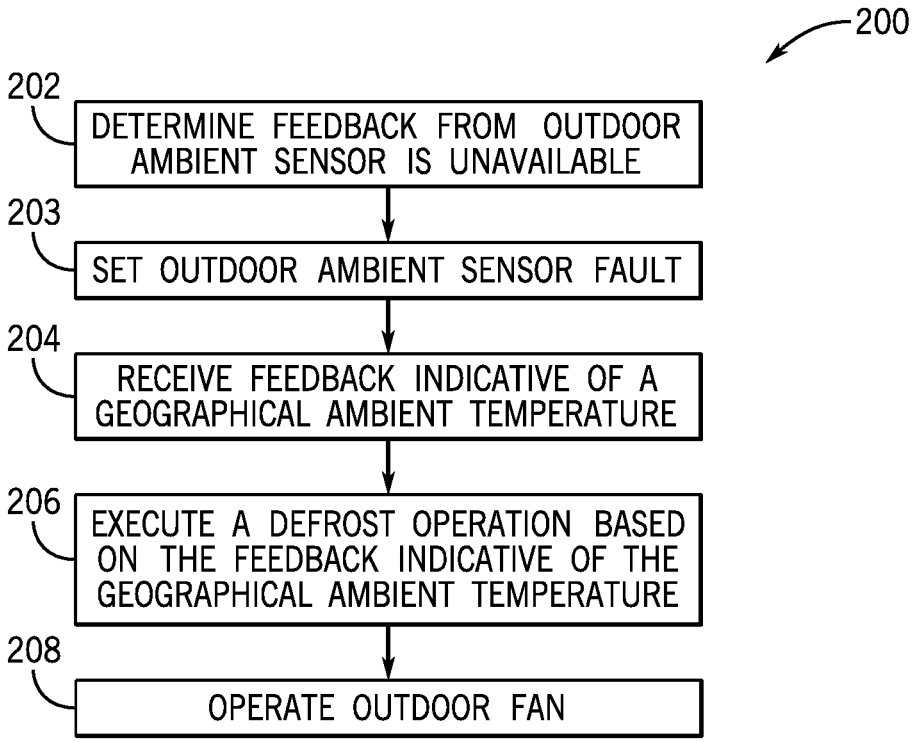
FIG. 8 is a flowchart of an embodiment of a method or process for operating a heat pump system in an alternative defrost mode when feedback from an outdoor ambient sensor is unavailable, in accordance with an aspect of the present disclosure.

FIG. 8 is a flowchart of an embodiment of a method or process 200 for operating the heat pump system 150 in an alternative defrost mode when feedback from the outdoor ambient sensor 176 is unavailable. The method 200 may be utilized in embodiments of the heat pump system 150 having one of the complex controllers 166B, 166C and having the complex equipment control connection system 186. Additionally, the method 200 may be utilized in embodiments in which the compressor 74 is a two stage compressor or a variable capacity compressor.

At block 202, the temperature measurement from the outdoor ambient sensor 176 is determined to be unavailable. As an example, the outdoor ambient sensor 176 may not be functioning properly and may not be successfully transmitting feedback to the controller 166. In another example, the outdoor ambient sensor 176 may be successfully transmitting feedback to the controller 166, but the controller 166 may determine that the temperature measurement provided by the outdoor ambient sensor 176 is inaccurate. For instance, the controller 166 may compare the temperature measurement received from the outdoor ambient sensor 176 with the surrounding temperature measurement determined by the onboard ambient temperature sensor 182 and/or a geographical ambient temperature measurement of the heat pump system 150 received via the network 188. The controller 166 may then determine that the difference between the temperature measurement received from the outdoor ambient sensor 176 and the onboard ambient temperature sensor temperature measurement and/or the geographical ambient temperature measurement may be greater than a threshold temperature. In another instance, the controller 166 may determine the temperature measurement received from the outdoor ambient sensor 176 has exceeded a temperature threshold associated with an expected temperature measurement. Thus, the controller 166 may determine that the temperature measurement received from the outdoor ambient sensor 176 is inaccurate and may not be used to control operation of the heat pump system 150. In such circumstances, the controller 166 may set an outdoor ambient sensor fault, as shown at block 203, but the controller 166 may not suspend operation of the heat pump system 150 due to the outdoor ambient sensor fault. The outdoor ambient sensor fault may send a notification, such as to an operator, that the outdoor ambient sensor 176 should be serviced to enable the outdoor ambient sensor 176 to transmit an accurate or usable ambient temperature measurement.

At block 204, feedback indicative of the geographical ambient temperature. The geographical ambient temperature is an ambient temperature alternative to the temperature measurement received from the outdoor ambient sensor 176, and is indicative of an ambient temperature at which the heat pump system 150 is located. The feedback may be transmitted to the controller 166 by the thermostat 172, which may receive information regarding the geographical ambient temperature via the network 188. In some embodiments, the network 188 may communicatively couple the thermostat 172 to a database, such as a cloud database, which may store the geographical ambient temperature of the heat pump system 150. In other embodiments, the geographical ambient temperature may be retrieved by the thermostat 172 from the internet or other external data source to which the thermostat 172 is connected via the network 188. The geographical ambient temperature may be approximately equal to the ambient temperature immediately surrounding the outdoor coil 152.

At block 206, the heat pump system 150 is operated in an alternative defrost mode using the geographical ambient temperature received by the network 188. The alternative defrost mode may be substantially similar to the primary defrost mode, except that the geographical ambient temperature received at block 204 may be used by the heat pump system 150 instead of the unavailable temperature measurement typically determined by the outdoor ambient sensor 176. For example, the heat pump system 150 may temporarily operate in the cooling mode in order to direct heated, pressurized refrigerant from the compressor 74 to the outdoor coil 152 and increase the temperature of the outdoor coil 152. In some embodiments, at block 208, the outdoor fan 162 may also be operated in this alternative defrost mode to direct air across the outdoor coil 152 and enable greater heat transfer between the air and the refrigerant within the outdoor coil 152 in order to increase the temperature of the outdoor coil 152. As an example, the complex controller 166B, 166C may operate the outdoor fan 162 at a high operational speed or at full capacity to transfer a greater amount of heat from the refrigerant to the outdoor coil 152. Indeed, the alternative defrost mode of the present embodiment may similarly execute other operations typically utilized with the primary defrost mode by substituting the temperature measurement typically determined by the outdoor ambient sensor 176 with the geographical ambient temperature received via the network 188.

It should be noted embodiments of the heat pump system 150 having the simplified controller 166A and/or the simplified equipment control connection system 184 may not be configured receive information from the network 188 and, therefore, may not receive feedback indicative of the geographical ambient temperature. Therefore, such embodiments of the heat pump system 150 may not be configured to operate in the alternative defrost mode depicted by the method 200 of FIG. 8.

Figure 9:
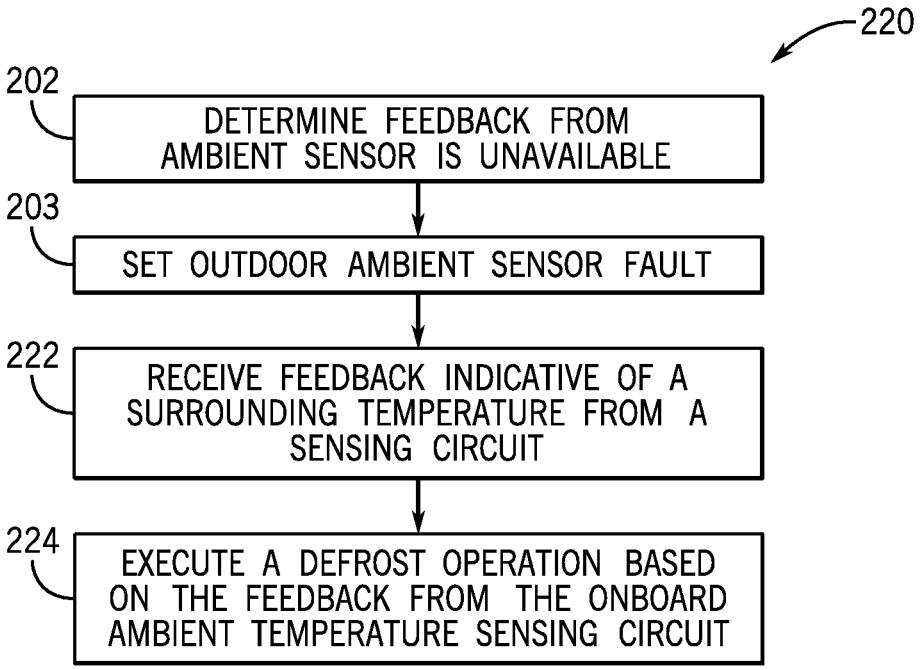
FIG. 9 is a flowchart of an embodiment of a method or process for operating a heat pump system in an alternative defrost mode when feedback from an outdoor ambient sensor is unavailable, in accordance with an aspect of the present disclosure.

FIG. 9 is a flowchart of an embodiment of another method or process 220 for operating the heat pump system 150 in an alternative defrost mode when feedback from the outdoor ambient sensor 176 is unavailable. The method 220 of FIG. 9 may be utilized with any of the embodiments of the heat pump system 150 discussed above. That is, the method 220 may be implemented in embodiments of the heat pump system 150 in which the compressor 74 is a single stage, two stage, or variable capacity compressor. Additionally, the method 220 may be utilized with any of the controllers 166A, 166B, and 166C and/or with embodiments of the heat pump system 150 having the simplified equipment control connection system 184 or the complex equipment control connection system 186.

In the method 220, at block 202, feedback from the outdoor ambient sensor 176 is determined to be unavailable. Upon this determination, at block 203, the outdoor ambient sensor fault may be set, but the controller 166 may not suspend operation of the heat pump system 150 due to the outdoor ambient sensor fault, as similarly above with reference to FIG. 8. At block 222, feedback indicative of a surrounding temperature, which is another ambient temperature alternative to the temperature measurement typically received from the outdoor ambient sensor 176, is received from the onboard ambient temperature sensor 182. As mentioned herein, the surrounding temperature determined by the onboard ambient temperature sensor 182 may be approximately equal to the ambient temperature determined by the outdoor ambient sensor 176. As discussed above, the onboard ambient temperature sensor 182 is a sensing circuit that may be integrated with the controller 166. For example, the onboard ambient temperature sensor 182 may be component of a control board of the controller 166, and the control board may be a component of an outdoor unit having the outdoor coil 152. In some embodiments, the heat pump system 150 may be calibrated to determine a relationship between the surrounding temperature determined by the onboard ambient temperature sensor 182 and the ambient temperature determined by the outdoor ambient sensor 176. For example, during the calibration, the surrounding temperature may be determined to differ from the surrounding temperature by a temperature differential. As a result, the surrounding temperature may be adjusted, such as via the controller 166, by the temperature differential, such that the calibrated or modified surrounding temperature more closely approximates the ambient temperature typically measured by the outdoor ambient sensor 176.

At block 224, an alternative defrost mode, which may be substantially similar to the primary defrost mode, may be operated using the surrounding temperature received by the onboard ambient temperature sensor 182 instead of the unavailable ambient temperature measurement typically determined by the outdoor ambient sensor 176. If a prior calibration was performed to determine a calibrated surrounding temperature, the calibrated surrounding temperature may be calculated and used to operate the alternative defrost mode more accurately. In other words, using the calibrated surrounding temperature may enable the heat pump system 150 to operate more similarly to the primary defrost mode, which uses the ambient temperature measurement received from the outdoor ambient sensor 176. It should be noted that, in some embodiments of the method 220 illustrated in FIG. 9, the outdoor fan 162 may not be operated in order to avoid unintentional interference with the surrounding temperature measurement and/or unintentional interference with a calibration adjustment made based on an expected difference between the surrounding temperature measurement received from the onboard ambient temperature sensor 182 and the ambient temperature measurement received from the outdoor ambient sensor 176. That is, operation of the outdoor fan 162 may diminish how accurately the surrounding temperature measurement or calibrated surrounding temperature measurement represents the ambient temperature measurement by affecting the surrounding temperature measurement itself. For example, forced air flow generated by the outdoor fan 162 may impact a temperature measurement detected by the onboard ambient temperature sensor 182 because the onboard ambient temperature sensor 182 may be exposed to the forced air flow. As such, the alternative defrost mode may not effectively or efficiently operate to defrost the outdoor coil 152 if the outdoor fan 162 is operated. Thus, operation of the outdoor fan 162 may be suspended to avoid affecting the operation of the alternative defrost mode in the method 220.

Figure 10:
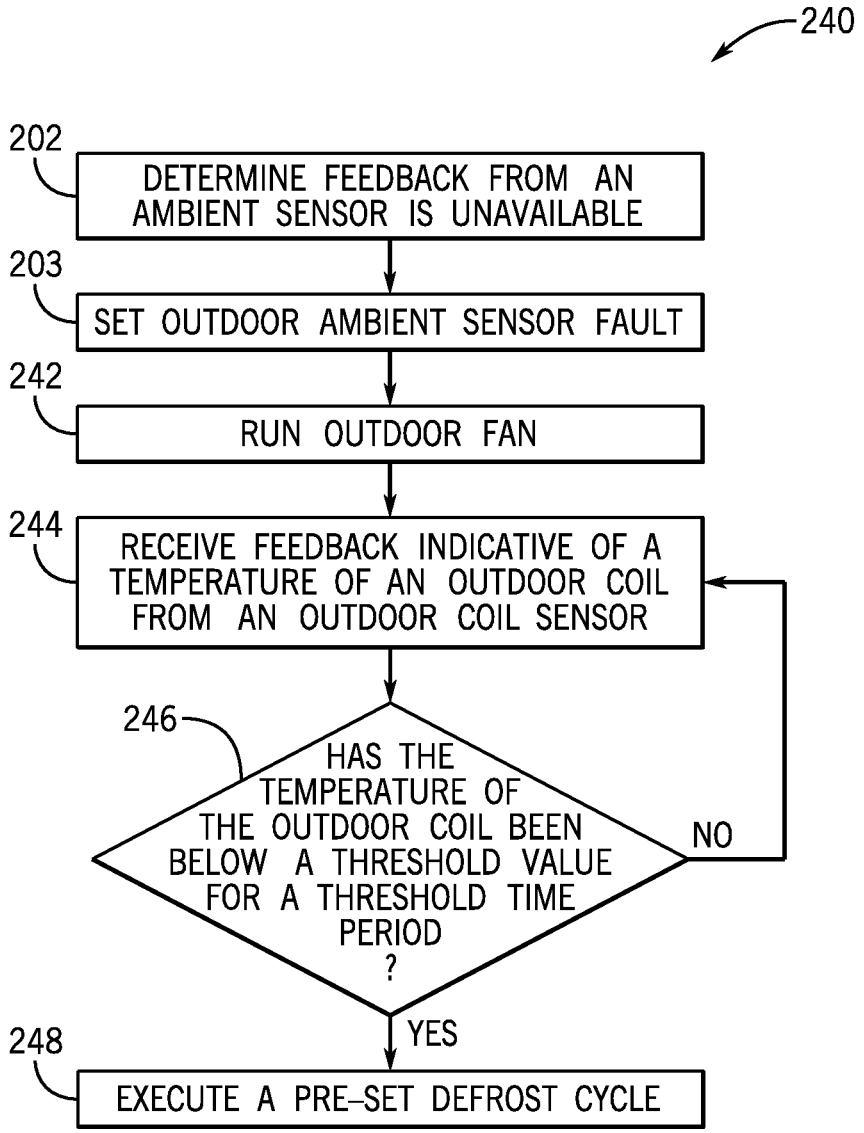
FIG. 10 is a flowchart of an embodiment of a method or process for operating a heat pump system in an alternative defrost mode when feedback from an outdoor ambient sensor is unavailable, in accordance with an aspect of the present disclosure.

FIG. 10 is a flowchart of an embodiment of a further method or process 240 for operating the heat pump system 150 in an alternative defrost mode when feedback from the outdoor ambient sensor 176 is unavailable. The method 240 of FIG. 10 may be utilized with embodiments of the heat pump system 150 having a single stage or two stage compressor. Additionally, the method 240 may be utilized with the controllers 166A, 166B and/or with embodiments of the heat pump system 150 having the simplified equipment control connection system 184 or the complex equipment control connection system 186.

At block 202, feedback from the outdoor ambient sensor 176 is determined to be unavailable. Upon this determination, the outdoor ambient sensor fault may be set, as shown at block 203, but the controller 166 may not suspend operation of the heat pump system 150 due to the outdoor ambient sensor fault, as similarly described above with reference to FIGS. 8 and 9. As a result, the heat pump system 150 may be operated in an alternative defrost mode.

In the alternative defrost mode illustrated in FIG. 10, the outdoor fan 162 may be operated to enable greater heat transfer between the refrigerant and the outdoor coil 152 in order to heat the outdoor coil 152, as indicated at block 242. Furthermore, at block 244, feedback indicative of the temperature of the outdoor coil 152 or an outdoor coil temperature is received from the outdoor coil sensor 178 and is continuously monitored. In accordance with the alternative defrost cycle described with reference to FIG. 10, the heat pump system 150 is configured to determine whether a defrost operation should be initiated based on the received outdoor coil temperature. Specifically, at block 246, the controller 166 determines if the outdoor coil temperature has been below a threshold temperature value for a threshold time period. For example, based on feedback from the outdoor coil sensor 178, the controller 166 may determine whether the outdoor coil temperature has been below 30 degrees Fahrenheit for greater than 30 consecutive minutes of compressor 74 operation. In certain embodiments, the threshold time period may be consecutive, but in alternative embodiments, the threshold time period may be cumulative. If the outdoor coil temperature has not been below the threshold temperature value for the threshold time period, no further action is performed, and the controller 166 continues to monitor the outdoor coil temperature at block 244.

However, if the controller 166 determines that the outdoor coil temperature has been below the threshold temperature for the threshold time period, a single defrost cycle of the heat pump system 150 may be executed, as shown at block 248. For example, the single defrost cycle involve similar operations as the primary defrost mode, such as temporary operation of the heat pump system 150 in the cooling mode. The single defrost cycle may have certain pre-set parameters, such as a pre-set time of operation, which may be 12 minutes. In some embodiments, after the single defrost cycle finishes, the alternative defrost mode may be exited. In additional or alternative embodiments, after the single defrost cycle finishes, the outdoor coil temperature may be determined again via the outdoor coil sensor 178. If the outdoor coil temperature is above another threshold temperature, the alternative defrost mode may be exited. However, if the outdoor coil temperature is below the threshold temperature, the defrost cycle executed at block 248 may be executed again.

As mentioned above, embodiments of the heat pump system 150 in which the compressor 74 is a variable capacity compressor may be unable to operate properly when feedback indicative or representative of the ambient temperature is unavailable. Thus, the method 240 may not be implemented in embodiments of the heat pump system 150 utilizing a variable capacity compressor.

In some embodiments, the methods 200, 220, 240 may be selected for implementation based on a priority scheme. In other words, if more than one of the methods 200, 220, 240 are available for implementation with a particular embodiment of the heat pump system 150, the controller 166 may select one of the methods 200, 220, and 240 according to the priority scheme. For example, in an embodiment of the heat pump system 150 that may operate according to any of the methods 200, 220, 240, the controller 166 may select the method 200 over the methods 220, 240. However, if the method 200 is not available in such an embodiment, such as if the thermostat 172 is not receiving the geographical ambient temperature via the network 188, the method 220 may then be selected over the method 240. Then, if the method 220 is not available, such as if feedback is not received from the onboard ambient temperature sensor 182, then the method 240 is selected by the controller 166. In general, the controller 166 may be configured to first utilize the method 200, if available, then utilize the method 220, if available, and then utilize method 240 if methods 200 and 220 are not available. In this way, when the ambient temperature typically determined by the outdoor ambient sensor 176 is unavailable, the controller 166 may selectively implement certain alternative defrost modes over other alternative defrost modes when multiple alternative defrost modes are available.

Figure 11:
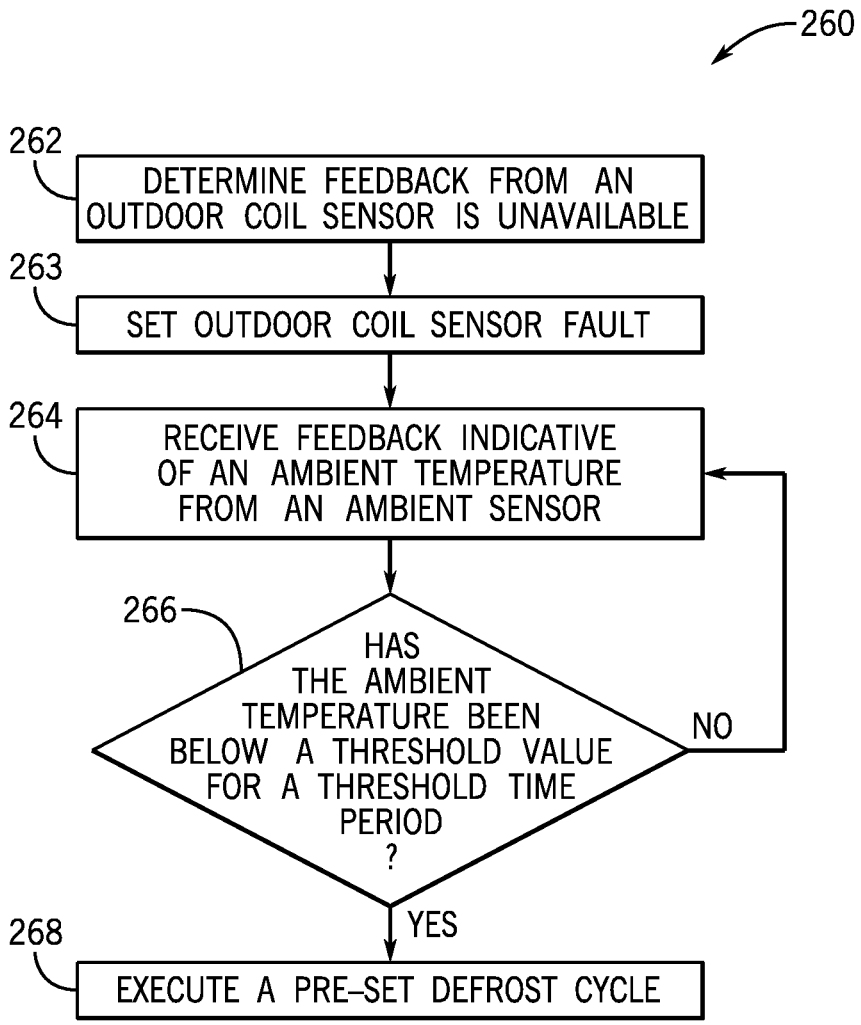
FIG. 11 is a flowchart of an embodiment of a method or process for operating a heat pump system in an alternative defrost mode when feedback from an outdoor coil sensor is unavailable, in accordance with an aspect of the present disclosure.

FIG. 11 is a flowchart of an embodiment of a method or process 260 for operating the heat pump system 150 in an alternative defrost mode when feedback from the outdoor coil sensor 178 is unavailable. The method 260 of FIG. 11 may be utilized with any of the embodiments of the heat pump system 150 discussed above. That is, the method 260 may be implemented in embodiments of the heat pump system 150 in which the compressor 74 is a single stage, two stage, or variable capacity compressor. Additionally, the method 260 may be utilized with any of the controllers 166A, 166B, and 166C and/or with embodiments of the heat pump system 150 having the simplified equipment control connection system 184 or the complex equipment control connection system 186.

At block 262, feedback from the outdoor coil sensor 178 is determined to be unavailable, such as missing or inaccurate. As a result, at block 263, an outdoor coil sensor fault may be set via the controller 166 to notify that the outdoor coil sensor 178 is to be serviced. However, operation of the heat pump system 150 may not be suspended by the controller 166 based on the determination. Instead, the heat pump system 150 may be operated in an alternative defrost mode.

At block 264, feedback indicative of the outdoor ambient temperature, which may be referenced by the controller 166 as a temperature alternative to the temperature measurement typically received from the outdoor coil sensor 178, may be received from the outdoor ambient sensor 176, and the ambient temperature may be continuously monitored by the controller 166. At block 266, the controller 166 determines if the ambient temperature received from the outdoor ambient sensor 176 has been below a threshold value for a threshold time period. In some embodiments, the threshold temperature value associated with the ambient temperature at block 266 may be different than the threshold temperature value associated with the outdoor coil temperature at block 246 of FIG. 10. Similarly, the threshold time period associated with the ambient temperature at block 266 may be different than the threshold time period associated with the outdoor coil at block 246 of FIG. 10. For example, the threshold temperature value associated with the ambient temperature in the method 260 may be lower, such as 15 degrees Fahrenheit lower, than the threshold temperature value associated with the outdoor coil temperature in the method 240 because the ambient temperature may be expected to be lower than the outdoor coil temperature during frost conditions of the outdoor coil 152. Additionally, the threshold time period associated with the ambient temperature in the method 260 may be greater, such as 5 minutes greater, than the threshold time period associated with the outdoor coil temperature in the method 240. Offsetting both the threshold temperature value and the threshold time period associated with the ambient temperature in the method 260 may better approximate a condition of the outdoor coil 152 in which executing a defrost cycle would be desired and/or would effectively raise the outdoor coil temperature and maintain a desired performance of the heat pump system 150.

At block 266, if the ambient temperature has not been below the threshold value for the threshold time period, no further action may be performed, and the ambient temperature may continue to be monitored via the controller 166. If the ambient temperature is determined to be below the threshold value for the threshold time period, a single defrost cycle having the pre-set parameters may be executed, as indicated at block 268. In certain embodiments, the defrost cycle executed at block 268 may be substantially similar to the defrost cycle executed at block 248 and may similarly have pre-set parameters. For example, in the defrost cycle of the illustrated alternative defrost mode, the heat pump system 150 may temporarily operate in the cooling mode for a pre-set period of time. In some implementations, after the defrost cycle at block 268 has been executed, the alternative defrost mode may be exited. Additionally or alternatively, after the single defrost cycle finishes, the ambient temperature may be determined again. If the ambient temperature is determined to be below another temperature threshold, the defrost cycle executed at block 268 may be executed again. If the ambient temperature is determined to be above the temperature threshold, the alternative defrost mode may be exited.

Figure 12:
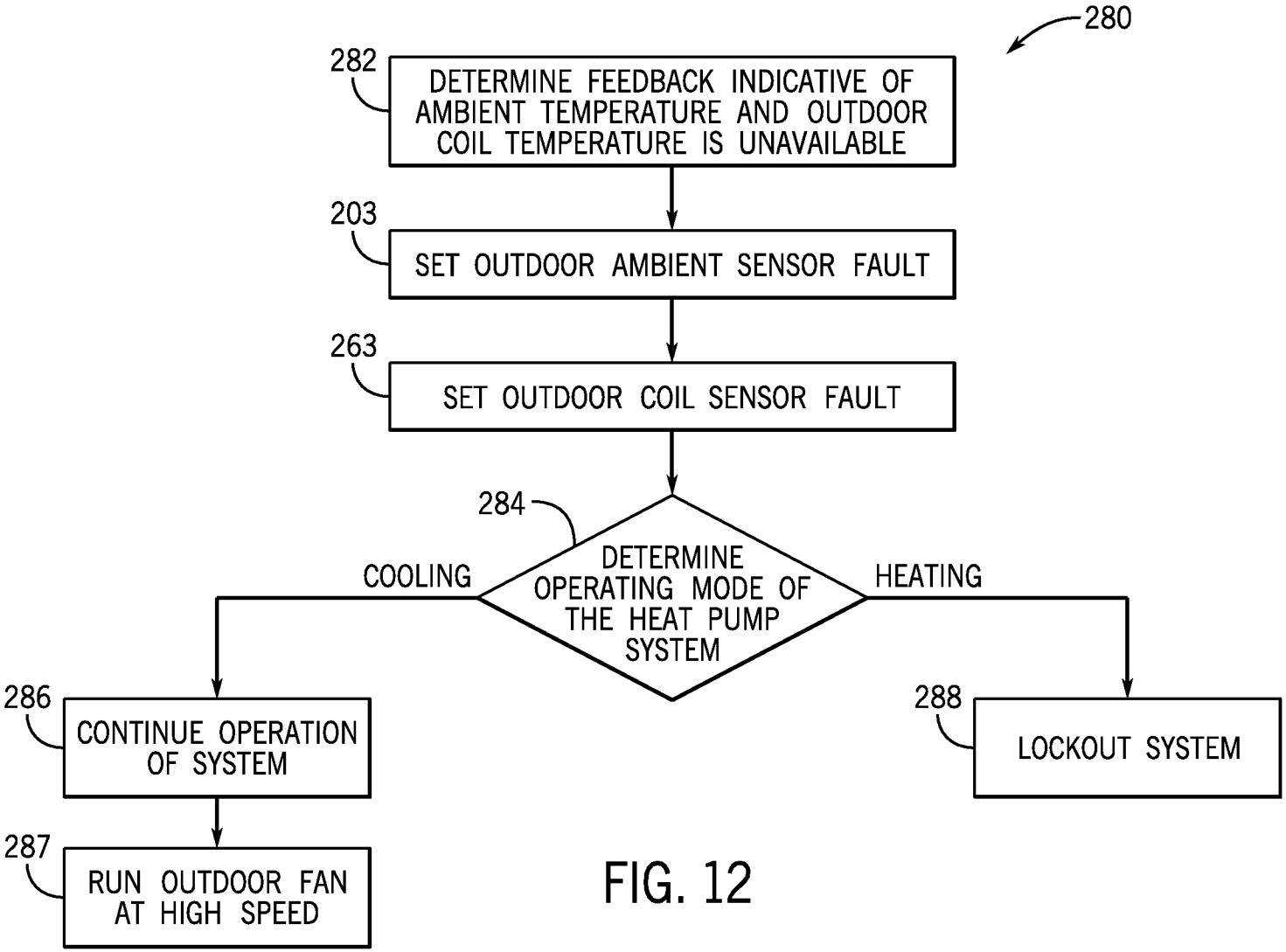
FIG. 12 is a flowchart of an embodiment of a method or process for operating a heat pump system in an alternative defrost mode with a simplified control configuration when feedback from both an outdoor ambient sensor and an outdoor coil sensor is unavailable, in accordance with an aspect of the present disclosure.
Figure 13:
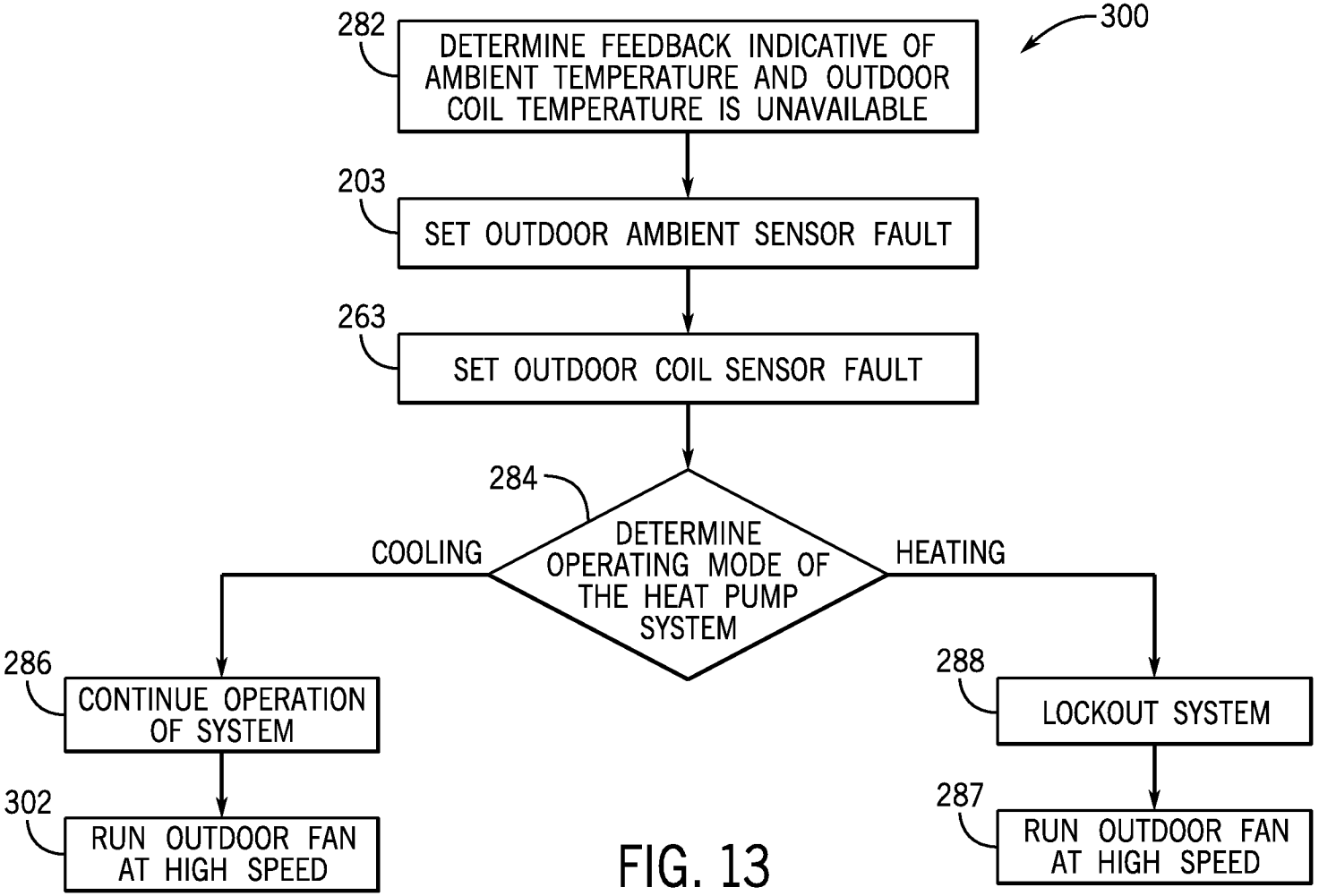
FIG. 13 is a flowchart of an embodiment of a method or process for operating a heat pump system with a complex control configuration when feedback from both an outdoor ambient sensor and an outdoor coil sensor is unavailable, in accordance with an aspect of the present disclosure.
Figure 14:
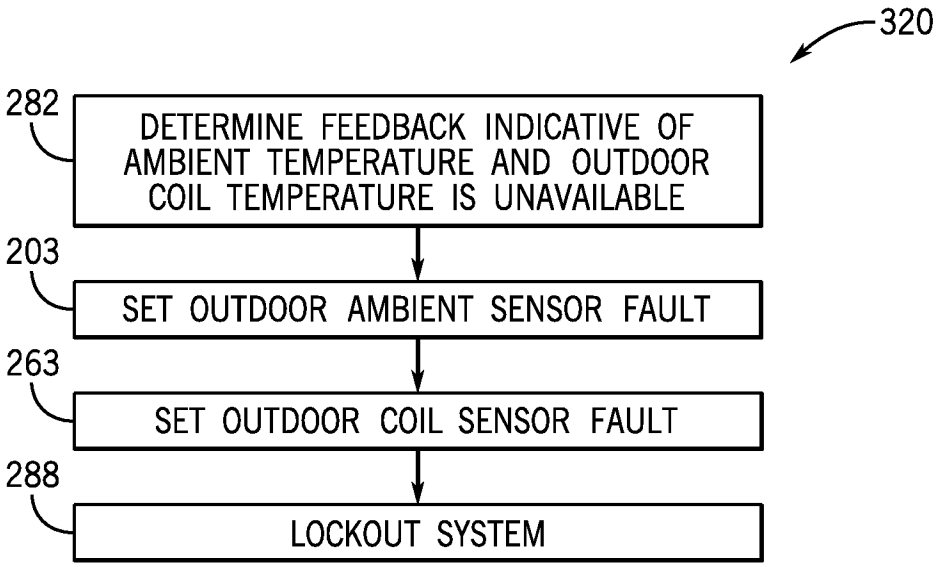
FIG. 14 is a flowchart of an embodiment of a method or process for operating a heat pump system in an alternative defrost mode with a complex control configuration when feedback from both an outdoor ambient sensor and an outdoor coil sensor is unavailable, in accordance with an aspect of the present disclosure.

Each of FIGS. 12-14 illustrates a method or process for operating the heat pump 150 when feedback indicative of both the ambient temperature and of the outdoor coil temperature is determined to be unavailable. However, for each of the methods described with reference FIGS. 12-14, the heat pump system 150 may not be operated in an alternative defrost mode in response to the determination that feedback indicative of the ambient temperature and of the outdoor coil temperature is unavailable. Rather, operation of the heat pump system 150 may be modified or suspended based on the unavailability of feedback from the outdoor ambient sensor 176 and the outdoor coil sensor 178 and based on the particular component configuration of the heat pump system 150.

For example, FIG. 12 is a flowchart of an embodiment of a method or process 280 that may be used by an embodiment of the heat pump system 150 having the simplified controller 166A, a single stage compressor, and the simplified equipment control connection system 184. The method 280 may be used for controlling operation of the heat pump system 150 when feedback from both the outdoor ambient sensor 176 and the outdoor coil sensor 178 is unavailable. At block 282, feedback indicative of the ambient temperature and of the outdoor coil temperature are determined to be unavailable. As a result, both the outdoor ambient sensor fault and the outdoor coil sensor fault may be set by the simplified controller 166A, as shown at blocks 203 and 263, respectively.

At block 284, the operation of the heat pump system 150 is determined. More specifically, it is determined whether the heat pump system 150 is in the cooling mode or in the heating mode. As an example, the controller 166A may determine whether the reversing valve 160 is energized to determine the operating mode of the heat pump system 150. If the reversing valve 160 is energized, the heat pump system 150 may be operating in the cooling mode, and if the reversing valve 160 is not energized, the heat pump system 150 may be operating in the heating mode. Additionally or alternatively, feedback transmitted by the thermostat 172 may indicate the operating mode of the heat pump system 150 and may be used to determine whether the heat pump system 150 is operating in the cooling mode or in the heating mode.

If the heat pump system 150 is determined to be operating in the cooling mode, the heat pump system 150 may continue to operate, as indicated at block 286. In the cooling mode, the temperature of the refrigerant flowing through the outdoor coil 152 from the compressor 74 and/or the temperature of the ambient environment 154 may be high enough to maintain the outdoor coil temperature above a particular temperature associated with frost conditions. Thus, execution of one of the defrost modes may not be desired, and the simplified controller 166A may continue to operate the heat pump system 150. At block 287, the outdoor fan 162 may be operated at a high operational speed and/or at full capacity to enable heat transfer from the heated refrigerant to the outdoor coil 152 in order to heat the outdoor coil 152 and cool the refrigerant.

If the operation of the heat pump system 150 is determined to be in the heating mode, operation of the heat pump system 150 may be locked out or suspended via the simplified controller 166A. In the heating mode, the temperature of the refrigerant flowing through the outdoor coil 152 and/or the temperature of the ambient environment 154 may be low enough to reduce the outdoor coil temperature and affect the performance of the heat pump system 150. In other words, when operating in the heating mode, the outdoor coil 152 may be susceptible to frost conditions. Thus, the heat pump system 150 may not be operated to avoid further reduction of the outdoor coil temperature.

FIG. 13 is a flowchart of an embodiment of a method or process 300 that may be used by an embodiment of the heat pump system 150 having the complex controller 166B, a two stage compressor, and the complex equipment control connection system 186. The method 300 may be used for controlling operation of the heat pump system 150 when feedback from both the outdoor ambient sensor 176 and the outdoor coil sensor 178 is unavailable. At block 282, feedback indicative of the ambient temperature and of the outdoor coil temperature are determined to be unavailable, and both the outdoor ambient sensor fault and the outdoor coil sensor fault may be set via the complex controller 166B.

At block 284, the operation of the heat pump system 150 is determined. As similarly described above with reference to FIG. 12, operation of the heat pump system 150 may be determined via a position or energization of the reversing valve 160. If the heat pump system 150 is operating in the cooling mode, the heat pump system 150 may continue to operate, as indicated at block 286. That is, heated refrigerant may continue to flow from the compressor 74 and through the outdoor coil 152. Additionally, at block 287, the outdoor fan 162 may be operated at a high operational speed to heat the outdoor coil 152 and cool the refrigerant.

If the heat pump system 150 is operating in the heating mode, operation of the heat pump system may be locked out or suspended, as shown at block 288, via the complex controller 166B. At block 287, the outdoor fan 162 may be operated at a high operational speed to mitigate formation of frost on the outdoor coil 152.

FIG. 14 is a flowchart of an embodiment of a method or process 320 that may be used by an embodiment of the heat pump system 150 having the complex controller 166C, a variable capacity compressor, and the complex equipment control connection system 186. The method 320 may be used for controlling operation of the heat pump system 150 when feedback from both the outdoor ambient sensor 176 and the outdoor coil sensor 178 is unavailable. At block 282, feedback indicative of the ambient temperature and of the outdoor coil temperature is determined to be unavailable, and both the outdoor ambient sensor fault and the outdoor coil sensor fault may be set via the complex controller 166C.

As mentioned above, embodiments of the heat pump system 150 having a variable capacity compressor may be configured to operate using the feedback indicative of the ambient temperature, and the complex controller 166C may not operate the heat pump system 150 when feedback indicative of the ambient temperature is unavailable. Therefore, in response to determining that feedback indicative of the ambient temperature is unavailable, operation of the heat pump system 150 may be locked out or suspended, as shown at block 288.

In addition to or as an alternative to operating in various defrost modes, the HVAC system may be configured to operate to condition the air flow provided to the space serviced by the HVAC system based on various sensors, including any of the sensors mentioned above. Some of the sensors may be considered refrigerant sensors, which are configured to determine operating parameters or properties that are particularly associated with the refrigerant directed through the HVAC system to exchange heat with the air flow. For instance, the refrigerant sensors may be configured to determine a temperature and/or pressure of the refrigerant at various sections or locations of the HVAC system, such as a compressor discharge location, a condenser location, an evaporator location, and the like. Operation of the HVAC system may depend on the determined properties of the refrigerant. Thus, the HVAC system may be operated or controlled based on the properties of the refrigerant in order to condition the air flow effectively, such as to adjust a temperature of the air flow more accurately.

If feedback from each of certain sensors is available, the HVAC system may operate in a primary conditioning mode to condition the air flow. In the primary conditioning mode, each operating parameter used by the HVAC system to control operation of the HVAC system and to condition the air flow may be received directly from each of the certain sensors. In other words, the HVAC system may receive feedback from each of the certain sensors during normal or primary operation. If feedback from any the sensors is unavailable, the HVAC system may operate in an alternative conditioning mode to condition the air flow. In the alternative conditioning mode, the HVAC system may use alternative feedback determined by a different sensor instead of using the unavailable feedback. That is, the unavailable feedback is replaced by different feedback that is available to the HVAC system, and the HVAC system may continue to operate to condition the air flow using the feedback that is available. Further, the alternative feedback that is used may be based on the particular feedback or the type of feedback that is unavailable. In other words, a specific type of alternative feedback may be selected, and the alternative feedback may correspond to or be associated with the unavailable feedback. In some embodiments, an adjustment or a calibration may be made to a value of an alternative operating parameter to reflect, represent, or approximate a value of an unavailable operating parameter more accurately. In any case, the HVAC system of the present disclosure is configured to operate and condition the air flow even when feedback from one of the sensors is unavailable. For this reason, the disclosed alternative conditioning mode enables the HVAC system to operate to condition the air flow as desired. It should be noted that embodiments of the primary conditioning mode and the alternative conditioning mode disclosed herein may be used in any suitable HVAC system, including the HVAC unit 12, the residential heating and cooling system 50, and/or the heat pump system 150.

Figure 15:
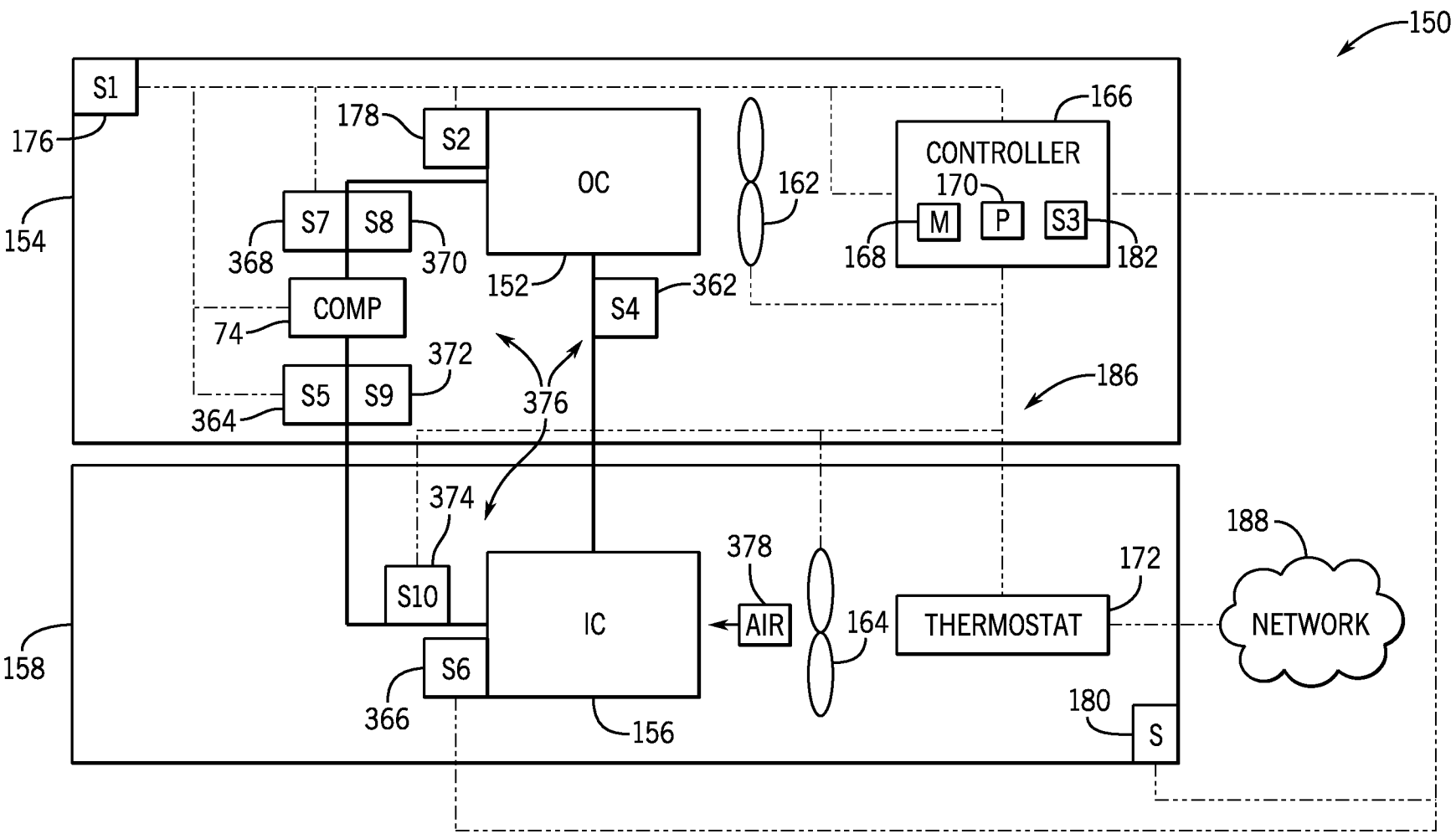
FIG. 15 is a schematic of an embodiment of an HVAC system configured to operate in a primary conditioning mode and/or an alternative conditioning mode, in accordance with an aspect of the present disclosure.

With this in mind, FIG. 15 is a schematic of an embodiment of an HVAC system 360 configured to operate in the primary conditioning mode and/or the alternative conditioning mode as described above. In the illustrated embodiment, the HVAC system 360 may include similar components, such as the compressor 74, the outdoor coil 152, the indoor coil 156, the controller 166, the thermostat 172, to the heat pump system 150. It should be noted that the controller 166 of the HVAC system 360 may be a complex controller, such as the controller 166B and/or the controller 166C, and is communicatively coupled to the other components of the HVAC system 360 via the complex equipment control connection system 186. Further, in addition to the outdoor ambient sensor 176, the outdoor coil sensor 178, and the sensors 180, the HVAC system 360 may have an outdoor liquid sensor 362 configured to determine a temperature of the refrigerant exiting the outdoor coil 152, an outdoor suction temperature sensor 364 configured to determine a temperature of the refrigerant entering a suction side of the compressor 74, an indoor evaporation temperature sensor 366 configured to determine a temperature of the indoor coil 156 and/or refrigerant within the indoor coil 156, and an outdoor discharge temperature sensor 368 configured to determine a temperature of the refrigerant pressurized and discharged by the compressor 74. Moreover, the HVAC system 360 may include an outdoor discharge pressure sensor 370 configured to determine a pressure of the refrigerant pressurized and discharged by the compressor 74, an outdoor suction pressure sensor 372 configured to determine a pressure of the refrigerant entering a suction side of the compressor 74, and an indoor evaporation pressure sensor 374 configured to determine a pressure of the refrigerant at or exiting the indoor coil 156.

Each of the sensors described above may be communicatively coupled to the controller 166 and may provide feedback to the controller 166 to indicate measurements of the respective operating parameters. At least some of the feedback from the sensors may be associated with a property of the refrigerant. For example, the respective feedback determined by the outdoor coil sensor 178, the outdoor liquid sensor 362, the outdoor suction temperature sensor 364, the indoor evaporation temperature sensor 366, the outdoor discharge temperature sensor 368, the outdoor discharge pressure sensor 370, the outdoor suction pressure sensor 372, and the indoor evaporation pressure sensor 374 may each be indicative of a respective pressure or temperature measurement of the refrigerant at a particular section or location of the HVAC system 360 along the refrigerant circuit. For this reason, such sensors may be referred to as refrigerant sensors 376.

The controller 166 may use the feedback from the refrigerant sensors 376 to determine how to operate various components of the HVAC system 360 so as to enable desirable operation of the HVAC system 360. For example, the controller 166 may operate the HVAC system 360 based on feedback from the refrigerant sensors 376 to enable a desirable amount of heat transfer between the refrigerant and an air flow 378, which may be directed across the indoor coil 156 by the indoor fan 164 to exchange heat with the refrigerant flowing through the indoor coil 156. In one example, the controller 166 may use the feedback from the refrigerant sensors 376 to adjust operation of the HVAC system 360 in order to condition the refrigerant such that the refrigerant within the indoor coil 156 reduces a temperature of the air flow 378 to a comfortable level for delivery within the structure 158. The comfortable level may be determined based on a user input via the thermostat 172 and/or the temperature of the ambient environment 154 as determined by the outdoor ambient sensor 176, for instance.

In some instances, if feedback from one or more of the refrigerant sensors 376, the outdoor ambient sensor 176, and/or the sensors 180 is determined to be unavailable, the controller 166 may operate the HVAC system 360 in the alternative conditioning mode. As mentioned above, in the alternative conditioning mode, the controller 166 may utilize available feedback from a different sensor in order to continue operating the HVAC system 360. In other words, the controller 166 continues to operate the HVAC system 360 to condition the air flow 378 by utilizing different, available sensor feedback to replace unavailable sensor feedback.

It should be noted that the controller 166, the thermostat 172, the refrigerant sensors 376, the outdoor ambient sensor 176, and the sensors 180 may be considered a part of a control system of the HVAC system 360. The control system generally controls operation of the HVAC system 360 to condition the air flow 378. Indeed, the control system may also include any other suitable component or feature of the HVAC system 360 not illustrated, such as other sensors, controllers, user input devices, and the like, to enable the HVAC system 360 to condition the air flow 378 desirably.

Figure 16:
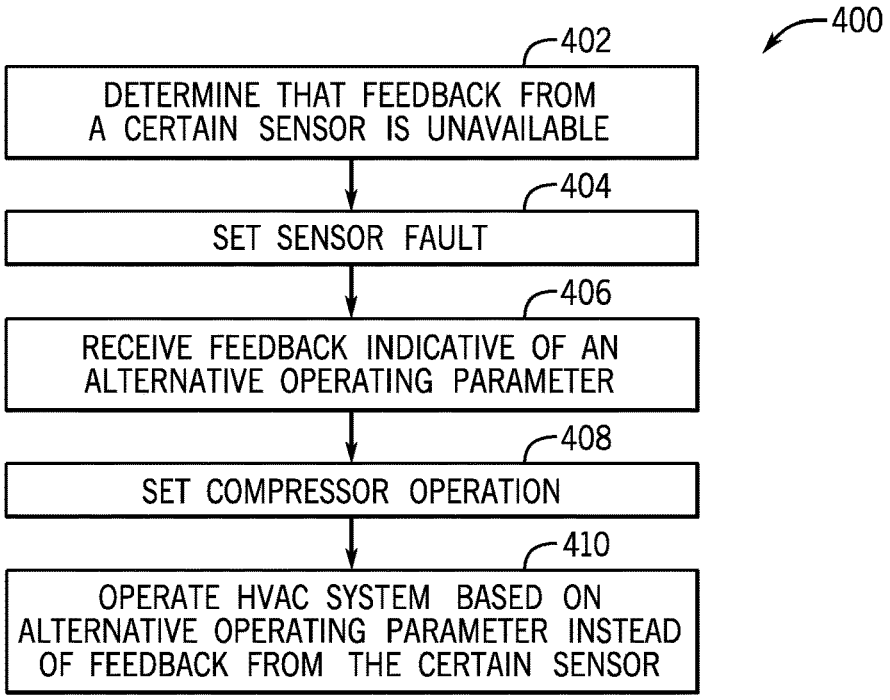
FIG. 16 is a flowchart an embodiment of a method or process for operating an HVAC system in an alternative conditioning mode, in accordance with an aspect of the present disclosure.

FIG. 16 is a flowchart of an embodiment of a method or process 400 for operating the HVAC system 360 in the alternative conditioning mode. The method 400 may be performed by a controller, such as the controller 166, of the HVAC system 360. It should be noted that the alternative conditioning mode may be performed differently than as depicted in FIG. 16. By way of example, steps may be performed in addition to the steps shown in the method 400, and/or certain steps of the method 400 may be removed, modified, performed in a different order, and/or performed concurrently with one another.

At block 402, a determination is made that feedback from a certain sensor is unavailable. Such sensor feedback may include feedback typically received from any of the refrigerant sensors 376, the outdoor ambient sensor 176, and/or the sensors 180. As a result of the sensor feedback being unavailable, the associated operating parameter provided with the sensor feedback, or a traditionally-utilized operating parameter, is also unavailable. As used herein, the traditional operating parameter refers to a particular operating parameter that is typically used for operating the HVAC system 360 in a normal or primary operating mode, when available.

Upon determining that the sensor feedback is unavailable, an appropriate sensor fault may be set, as shown at block 404, based on the type of sensor from which the sensor feedback is unavailable. That is, a notification may be flagged to indicate that the sensor associated with the unavailable feedback may not be functioning as desired. Thus, a user, such as an operator, may be prompted to service the sensor to enable the sensor to transmit usable feedback for operation of the HVAC system 360.

At block 406, feedback indicative of an alternative operating parameter is received from another one of the sensors, such as at least one of the refrigerant sensors 376, the outdoor ambient sensor 176, and/or the sensors 180 that are functioning. The alternative operating parameter may be related to the traditional or primary operating parameter that is unavailable. For example, the alternative operating parameter may be utilized to generate an approximation of the traditional or primary operating parameter.

Furthermore, a particular operation of the compressor 74 may be selected, as indicated at block 408. Such operation may be pre-determined based on the type of compressor 74 employed by the HVAC system 360. By way of example, at the step of block 408, a variable capacity compressor may be set to operate at de-rated nominal capacity values as defined during development or testing of the HVAC system 360 in order to reduce or limit the operation of the compressor 74. In another embodiment, at block 408, a two stage compressor may be adjusted to operate in a first stage and not in a second stage in order to reduce pressurization of the refrigerant by the compressor 74. In a further embodiment, at block 408, a single stage compressor may continue to operate in similar conditions in the alternative conditioning mode as that in the primary conditioning mode.

At block 410, the HVAC system 360 is operated to condition the air flow 378 based on the value of the alternative operating parameter rather than the value of the traditional operating parameter that is unavailable. In some embodiments, a calibration or adjustment is made to the value of the alternative operating parameter to approximate the traditional operating parameter. The calibration may be determined based on manufacture, development, and/or testing of the HVAC system 360, such as based on the specification of the equipment implemented in the HVAC system 360, the geographic location of the HVAC system 360, and so forth. In this manner, the HVAC system 360 may condition the air flow 378 in the alternative conditioning mode desirably based on the particular implementation of the HVAC system 360.

It should be noted that the specific alternative operating parameter utilized in place of the traditional operating parameter may be selected based on the particular traditional operating parameter determined to be unavailable. In certain embodiments, feedback from one of the refrigerant sensors 376 may generally correspond with feedback from another one of the refrigerant sensors 376. For instance, if feedback from the outdoor liquid sensor 362 is determined to be unavailable, the feedback from the outdoor coil sensor 178 may be used instead, because the alternative operating parameter of the temperature of the outdoor coil 152, as determined by the outdoor coil sensor 178, may be used to approximate the traditional operating parameter of the temperature of the refrigerant exiting the outdoor coil 152 of the refrigerant circuit, as determined by the outdoor liquid sensor 362.

In another example, if feedback from the outdoor suction temperature sensor 364 is determined to be unavailable, the feedback from the indoor evaporation temperature sensor 366 may be used, because the alternative operating parameter of the temperature of the indoor coil 156, as determined by the indoor evaporation temperature sensor 366, may be used to approximate the traditional operating parameter of the temperature of the refrigerant on a suction side of the compressor 74, as determined by the outdoor suction temperature sensor 364. Similarly, if feedback from the indoor evaporation temperature sensor 366 is determined to be unavailable, the feedback from the outdoor suction temperature sensor 364 may be used.

Moreover, if feedback from the indoor evaporation pressure sensor 374 is determined to be unavailable, the feedback from the outdoor suction pressure sensor 372 may be used, because the alternative operating parameter of the pressure of the refrigerant at the suction side of the compressor 74 of the refrigerant circuit, as determined by the outdoor suction pressure sensor 372, may be used to approximate the traditional operating parameter of the pressure of the refrigerant exiting the indoor coil 156 of the refrigerant circuit, as determined by the indoor evaporation pressure sensor 374. In this manner, when feedback from one of the refrigerant sensors 376 is unavailable, feedback from one of the other refrigerant sensors 376 may be used with or without adjusting a value of the alternative operating parameter.

Further, feedback from one of the refrigerant sensors 376 may generally correspond with feedback from the outdoor ambient sensor 176, such that feedback from one of the refrigerant sensors 376 may be utilized as an alternative operating parameter instead of feedback from the outdoor ambient sensor 176, in some instances. In an example, if the feedback from the outdoor ambient sensor 176 is determined to be unavailable, the feedback from the outdoor coil sensor 178 may be used, because the alternative operating parameter of the temperature of the outdoor coil 152, as determined by the outdoor coil sensor 178, may be used to approximate the traditional operating parameter of the temperature of the ambient environment 154, as determined by the outdoor ambient sensor 176. Similarly, if the feedback from the outdoor coil sensor 178 is determined to be unavailable, the feedback from the outdoor ambient sensor 176 may be used. In this case, the feedback from the outdoor ambient sensor 176 and the feedback from the outdoor coil sensor 178 may be used to substitute one another based on which feedback is unavailable. In some embodiments, the substitute feedback may be utilized after an adjustment value, which may be determined based on product development data, is added or subtracted from the substitute feedback value.

In some embodiments, if feedback from one of the refrigerant sensors 376 is unavailable, available feedback from more than one of the other refrigerant sensors 376 may be used in combination with feedback from another sensor, such as the outdoor ambient sensor 176 in the alternative conditioning mode. For instance, if feedback from the outdoor discharge temperature sensor 368 is unavailable, feedback from the outdoor discharge pressure sensor 370 and from the outdoor ambient sensor 176 may be used. In other words, the temperature of the refrigerant pressurized by the compressor 74, as determined by the outdoor discharge temperature sensor 368, may be correlated with, or may be approximated based on, both the pressure of the refrigerant pressurized by the compressor 74, as determined by the outdoor discharge pressure sensor 370, and the temperature of the ambient environment 154, as determined by the outdoor ambient sensor 176. Likewise, if feedback from the outdoor discharge pressure sensor 370 is unavailable, feedback from the outdoor discharge temperature sensor 368 and from the outdoor ambient sensor 176 may be used to approximate the discharge pressure of the refrigerant.

Furthermore, if feedback from the outdoor suction pressure sensor 372 is unavailable, then feedback from the indoor evaporation pressure sensor 374 and from the outdoor ambient sensor 176 may be used to approximate the suction pressure of the refrigeration. That is, the pressure of the refrigerant at the suction side of the compressor 74, as determined by the outdoor suction pressure sensor 372, may be correlated with, or may be approximated based on, the pressure of the refrigerant exiting the indoor coil 156, as determined by the indoor evaporation pressure sensor 374, and the temperature of the ambient environment 154, as determined by the outdoor ambient sensor 176. By using the feedback from the outdoor ambient sensor 176 in conjunction with feedback from one of the refrigerant sensors 376, a more accurate representation or approximation of the unavailable feedback may be generated to enable the HVAC system 360 to condition the air flow 378 desirably.

Although FIG. 16 illustrates that the alternative operating parameter is used for operating the HVAC system 360 to condition the air flow 378 when the traditional operating parameter is unavailable, it should be noted that the alternative operating parameter may also be used for operating the HVAC system 360 to condition the air flow 378 when respective feedback from all sensors is available. In other words, when feedback from all sensors is available, each operating parameter, including the traditional operating parameter and the alternative operating parameter, monitored by the sensors may be used for conditioning the air flow 378 desirably. However, if the traditional operating parameter is no longer available, the alternative operating parameter, or an adjustment to the alternative operating parameter, may be used to substitute the unavailable traditional operating parameter so as to continue operation of the HVAC system 360 for conditioning the air flow 378 desirably.

It should also be noted that the method 400 may be combined with any of the other methods described above. For example, if feedback from the outdoor ambient sensor 176 is unavailable, feedback indicative of a geographical ambient temperature, which may be received from the network 188 as described with reference to block 204 of FIG. 8, and/or feedback indicative of a surrounding temperature, which may be received from the onboard ambient temperature sensor 182 as described with reference to block 222 of FIG. 9, may be used in addition or as an alternative to the feedback from the outdoor coil sensor 178. Moreover, any suitable combination of feedback from any of the outdoor ambient sensor 176, the sensors 180, the refrigerant sensors 376, or any other sensor of the HVAC system 360 may be used as an alternative to unavailable feedback.

Figure 17:
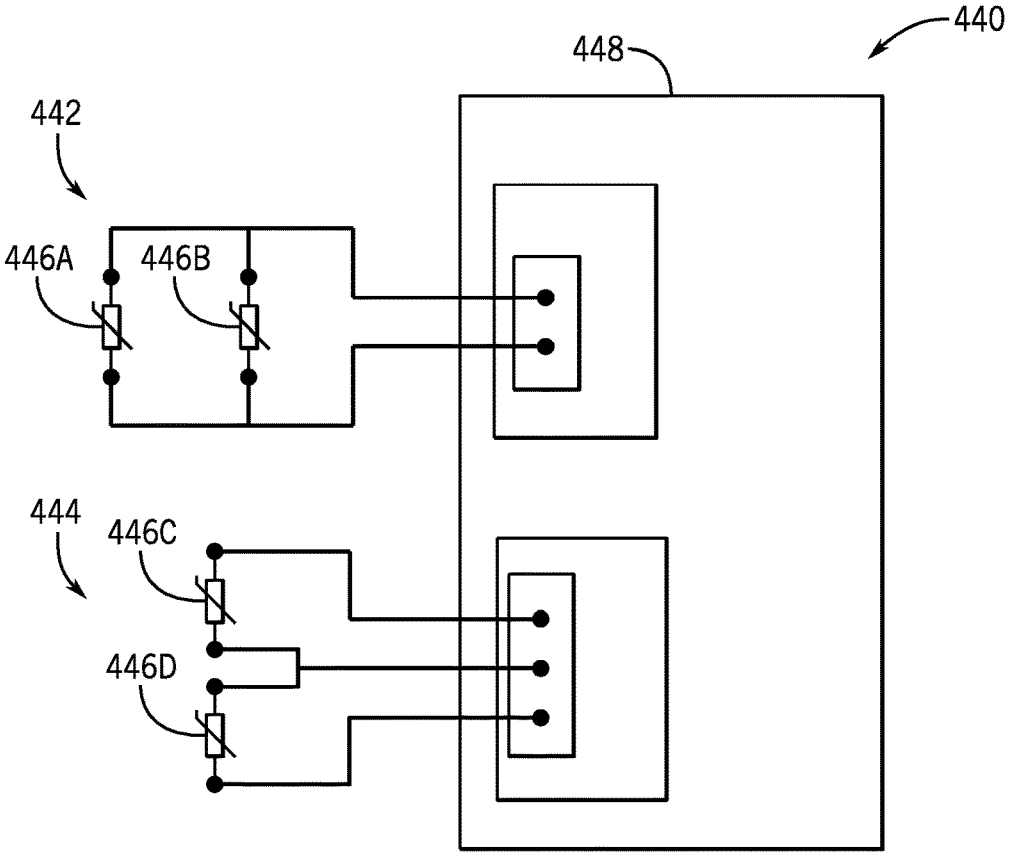
FIG. 17 is a schematic of an embodiment of a sensor system that may be utilized by an HVAC system, in accordance with an aspect of the present disclosure.

FIG. 17 is a schematic of an embodiment of a sensor system 440 having a first sensor 442 and a second sensor 444, each having a different configuration, which will be discussed in further detail below. Each of the sensors 442, 444 may be a temperature sensor configured to be employed by the heat pump system 150 and/or the HVAC system 360. For example, either of the first sensor 442 and the second sensor 444 may be used for the any of the outdoor ambient sensor 176, the sensors 180, and/or the refrigerant sensors 376 configured to determine a temperature. Each sensor 442, 444 may include a plurality of resistors 446. Although FIG. 17 illustrates each sensor 442, 444 as including two resistors 446, in additional or alternative embodiments, each sensor 442, 444 may include any suitable number of resistors 446. Each resistor 446 may be a thermistor whose resistance is based on temperature. A sensor controller 448, which may be the controller 166 and/or a separate controller, may be communicatively coupled to the sensors 442, 444 and may receive feedback that includes a total resistance value of the respective sensor 442, 444. The total resistance value is based on the resistance value of each resistor 446 and the arrangement of the plurality of resistors 446 of the respective sensor 442, 444, as further described below. The sensor controller 448 may then use the total resistance value to determine the corresponding temperature value associated with the total resistance value, thereby determining the respective temperature reading associated with the sensor 442, 444. In some embodiments, the sensor controller 448 may use a database table that correlates each total resistance value with a temperature value. The sensor controller 448 may then use the database table to match a received total resistance value with the corresponding temperature value. In additional or alternative embodiments, the sensor controller 448 may use an equation that relates the total resistance value with a temperature value. That is, the sensor controller 448 may receive a total resistance value and use the equation to calculate the temperature value based on the total resistance value.

It should be noted that by using a plurality of resistors 446 in each sensor 442, 444, the respective sensors 442, 444 may continue to provide feedback that includes a total resistance value even if one of the resistors 446 is not operational. In other words, if a resistance value of one of the resistors 446 of one of the sensors 442, 444 is unavailable, the total resistance value may be based on the resistance values provided by the remaining resistors 446 of that sensor 442, 444. As such, the sensors 442, 444 may continue to provide a total resistance value, and the sensor controller 448 may determine a temperature reading associated with the respective sensors 442, 444 so long as at least one of the respective resistors 446 of the sensors 442, 444 is providing a resistance value. If the resistance value of one of the resistors 446 is unavailable, there may be a new relationship between the temperature value and the total resistance value derived from the remaining resistors 446. Thus, the sensor controller 448 may be configured to determine if a resistance value of one of the resistors 446 is unavailable based on a comparison to an expected total resistance value or range of resistance values for the particular sensor 442, 444. In response to a determination that a resistance value of one of the resistors 446 is unavailable, the sensor controller 448 may adjust the determination of the corresponding temperature value accordingly. For instance, the sensor controller 448 may reference an alternative database table or an alternative equation correlating the temperature with the new total resistance value.

The first sensor 442 includes a first resistor 446A and a second resistor 446B that are arranged in parallel with one another. In the parallel arrangement, the total resistance value of the first sensor 442 is equal to the reciprocal of the sum of the reciprocals of the resistance values of the first resistor 446A and the second resistor 446B. For instance, the first resistor 446A may have a first baseline resistance value of 8,000 ohms, and the second resistor 446B may have a second baseline resistance value of 2,000 ohms. The reciprocal of the first baseline resistance value is 1/8000, and the reciprocal of the second baseline resistance value is 1/2,000. The sum of the reciprocals is 1/1,600. The reciprocal of the sum of the reciprocals, or the baseline total resistance value of the first sensor 442, is then 1,600 ohms. Thus, the sensor controller 448 may determine a temperature associated with the first sensor 442 based on the baseline total resistance value of 1,600 ohms. For example, a determined total resistance of 1,600 ohms may correspond to a particular baseline temperature value, and determined resistances deviating from the 1,600 ohms may correspond to temperature readings deviating from the particular baseline temperature value. However, if the resistance value from the first resistor 446A is unavailable, the resistance value from the second resistor 446B, which has the second baseline resistance value of 2000 ohms, may be the sole remaining measurable resistance value for the first sensor 442. As a result, the sensor controller 448 may then determine the temperature associated with the first sensor 442 based on a baseline total resistance value of 2,000 ohms. In other words, a determined total resistance of 2,000 ohms may correspond to the same particular baseline temperature value, and determined resistances deviating from the 2,000 ohms may correspond to temperature readings deviating accordingly from the particular baseline temperature value.

The second sensor 444 includes a third resistor 446C and a fourth resistor 446D that are arranged in series with one another. In the series arrangement, the total resistance value of the second sensor 444 is equal to the sum of each resistance value of the third resistor 446C and the fourth resistor 446D. By way of example, the third resistor 446C may have a third baseline resistance value of 2,000 ohms, and the fourth resistor 446D may have a fourth baseline resistance value of 3,000 ohms. The sum of the third baseline resistance value and the fourth baseline resistance value, or the baseline total resistance value of the second sensor 444 is then 5,000 ohms. As such, the sensor controller 448 may determine the temperature associated with the second sensor 444 based on the baseline total resistance value of 5,000 ohms. That is, a determined resistance of 5,000 ohms may correspond to an additional baseline temperature value, and determined resistances deviating from 5,000 ohms may correspond to temperature readings that deviate from the additional baseline temperature value. If the resistance value of the third resistor 446C is unavailable, the resistance value from the fourth resistor 446D, which has a baseline resistance value of 3,000 ohms, may be the sole remaining measurable resistance value of the second sensor 444. Therefore, the sensor controller 448 may then determine the temperature associated with the second sensor 444 based on the baseline resistance of 3,000 ohms. Stated in a different way, a determined resistance of 3,000 ohms corresponds to the same additional baseline temperature value, and determined resistances that deviate from 3,000 ohms correspond to temperature readings that deviate from the additional baseline temperature value.

It should be noted that the disclosed sensor 442, 444 configurations, which utilize multiple resistors, whether arranged in series or in parallel, enable the continued utilization of the sensors 442, 444 to measure temperature even if one of the respective resistors of one of the sensors 442, 444 ceases to function properly. By way of example, the sensor controller 448 may be configured to detect an unexpected variation in the total resistance of the sensor 442, 444 and may be programmed or configured to adjust or modify the temperature determination based on the remaining resistors accordingly.

The present disclosure may provide one or more technical effects useful in the operation of an HVAC system. For example, the HVAC system may be configured to use feedback from various sensors to condition an air flow desirably. When certain feedback from a certain sensor or type of sensor is unavailable, the HVAC system may use alternative feedback from other sensors or types of sensors. In this way, the HVAC system may continue to condition the air flow even when certain sensors are faulty or unable to provide feedback traditionally utilized to operate the HVAC system. In some embodiments, the HVAC system is a heat pump system configured to use the feedback from the sensors to operate in a primary defrost mode to maintain the temperature of an outdoor coil above a threshold temperature when feedback from certain sensors is available. When feedback from one of the certain sensors is unavailable, the heat pump system may operate in an alternative defrost mode that replaces the unavailable feedback with alternative feedback to continue to operate and maintain the temperature of the outdoor coil above the threshold temperature. In additional or alternative embodiments, the HVAC system is configured to use the feedback from the certain sensors to operate in a primary conditioning mode to exchange a target amount of heat between a refrigerant and the air flow when feedback from the certain sensors is available. When feedback from one of the sensors is unavailable, the HVAC system may operate in an alternative conditioning mode that replaces the unavailable feedback with alternative feedback to continue to operate and condition the air flow desirably. In any case, operation of the HVAC system is improved when certain feedback from one of the sensors is unavailable. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and air conditioning (HVAC) system, comprising:

a first sensor configured to determine a first temperature;

a plurality of second sensors, wherein the plurality of second sensors is configured to determine a plurality of second temperature values; and a controller communicatively coupled to the first sensor and to the plurality of second sensors, wherein the controller is configured to:

operate the HVAC system to defrost a coil of the HVAC system based on the first temperature in response to determining that feedback indicative of the first temperature is available from the first sensor; and in response to determining that the feedback indicative of the first temperature is unavailable from the first sensor, select a second temperature value of the plurality of second temperature values based on a priority scheme and operate the HVAC system to defrost the coil based on the second temperature value.

2. The HVAC system of claim 1, wherein the controller comprises a control board, the first sensor comprises an outdoor ambient temperature sensor, and the plurality of second sensors comprises a sensing circuit integrated with the control board.

3. The HVAC system of claim 1, wherein the first sensor comprises an outdoor ambient temperature sensor, the first temperature comprises an outdoor ambient temperature, the plurality of second sensors comprises a thermostat coupled to a network and configured to determine an ambient temperature at a geographic location of the HVAC system via the network, and the second temperature value comprises the ambient temperature at the geographic location of the HVAC system.

4. The HVAC system of claim 1, wherein the first temperature comprises an outdoor ambient temperature, and the second temperature value comprises a coil temperature of the coil.

5. The HVAC system of claim 4, wherein the controller is configured to:

determine whether the coil temperature has been below a threshold temperature for a threshold time period; and execute a pre-set defrost cycle to defrost the coil in response to determining that the coil temperature has been below the threshold temperature for the threshold time period.

6. The HVAC system of claim 1, wherein the first temperature comprises a coil temperature of the coil, and the second temperature value comprises an outdoor ambient temperature.

7. The HVAC system of claim 6, wherein the controller is configured to:

determine whether the outdoor ambient temperature has been below a threshold temperature for a threshold time period; and execute a pre-set defrost cycle to defrost the coil in response to determining that the outdoor ambient temperature has been below the threshold temperature for the threshold time period.

8. A non-transitory computer-readable medium comprising instructions that, when executed by one or more processors, are configured to cause the one or more processors to:

operate a heating, ventilation, and air conditioning (HVAC) system to defrost a coil of the HVAC system based on a first temperature measurement in response to determining the first temperature measurement is available;

determine the first temperature measurement is unavailable; and in response to determining the first temperature measurement is unavailable, select an alternative temperature measurement from a plurality of alternative temperature measurements based on a priority scheme and operate the HVAC system to defrost the coil based on the alternative temperature measurement.

9. The non-transitory computer-readable medium of claim 8, wherein the instructions, when executed by the one or more processors, are configured to cause the one or more processors to:

receive the first temperature measurement via feedback from a sensor of the HVAC system; and determine the first temperature measurement is unavailable based on the feedback from the sensor being unavailable.

10. The non-transitory computer-readable medium of claim 9, wherein the sensor is a first sensor, and the instructions, when executed by the one or more processors, are configured to cause the one or more processors to receive the plurality of alternative temperature measurements from a plurality of additional sensors of the HVAC system.

11. The non-transitory computer-readable medium of claim 10, wherein the instructions, when executed by the one or more processors, are configured to cause the one or more processors to:

adjust the alternative temperature measurement to provide an adjusted temperature value; and operate the HVAC system to defrost the coil based on the adjusted temperature value.

12. The non-transitory computer-readable medium of claim 8, wherein the instructions, when executed by the one or more processors, are configured to cause the one or more processors to:

determine a total resistance value of a plurality of resistors based on a respective resistance value of each resistor of the plurality of resistors;

reference data correlating the total resistance value with a temperature value; and determine the first temperature measurement based on the temperature value.

13. The non-transitory computer-readable medium of claim 12, wherein the instructions, when executed by the one or more processors, are configured to cause the one or more processors to:

determine a particular resistance value of one of the plurality of resistors is unavailable;

determine a new total resistance value of the plurality of resistors based on the respective resistance values of remaining available resistors of the plurality of resistors;

reference alternative data correlating the new total resistance value with an updated temperature value; and determine the first temperature measurement based on the updated temperature value.

14. The non-transitory computer-readable medium of claim 8, wherein the instructions, when executed by the one or more processors, are configured to cause the one or more processors to:

determine whether the alternative temperature measurement has been below a threshold temperature for a threshold time period in response to determining the first temperature measurement is unavailable; and execute a pre-set defrost cycle to defrost the coil in response to determining that the alternative temperature measurement has been below the threshold temperature for the threshold time period.

15. A heat pump system, comprising:

an outdoor coil; and a controller configured to:

receive first feedback from a first sensor;

receive second feedback from a plurality of additional sensors, wherein the second feedback comprises a plurality of alternative measurements;

operate the heat pump system to defrost the outdoor coil based on the first feedback in response to receiving the first feedback from the first sensor;

determine that the first feedback is unavailable; and in response to determining that the first feedback is unavailable, select an alternative measurement of the plurality of alternative measurements based on a priority scheme and operate the heat pump system to defrost the outdoor coil based on the alternative measurement.

16. The heat pump system of claim 15, wherein the first feedback is indicative of a first temperature measurement, and at least one of the plurality of alternative measurements of the second feedback is indicative of a second temperature measurement.

17. The heat pump system of claim 16, wherein the controller is configured to determine the first feedback is unavailable in response to determining the first feedback is not received by the controller or in response to determining the first temperature measurement exceeds a threshold temperature.

18. The heat pump system of claim 16, wherein the first temperature measurement comprises a temperature of the outdoor coil, and the at least one of the plurality of alternative measurements comprises an outdoor ambient temperature.

19. The heat pump system of claim 15, comprising a fan, wherein the controller is configured to operate the fan at full capacity to defrost the outdoor coil based on the alternative measurement.

20. The heat pump system of claim 15, wherein the controller is configured to:

determine the second feedback is unavailable;

determine an operating mode of the heat pump system in response to determining the first feedback is unavailable and the second feedback is unavailable; and suspend operation of the heat pump system in response to determining that the operating mode of the heat pump system is a heating mode.

* * * * *